United States Patent [19]

Yamaguchi

[11] Patent Number: 4,760,896

[45] Date of Patent: Aug. 2, 1988

[54] APPARATUS FOR PERFORMING GROUP CONTROL ON ELEVATORS

[75] Inventor: Toru Yamaguchi, Tokyo, Japan

[73] Assignee: Kabushiki Kaisha Toshiba, Tokyo, Japan

[21] Appl. No.: 102,587

[22] Filed: Sep. 29, 1987

[30] Foreign Application Priority Data

Oct. 1, 1986 [JP] Japan ..... 61-231265
Oct. 23, 1986 [JP] Japan ..... 61-252291
Oct. 23, 1986 [JP] Japan ..... 61-252293

[51] Int. Cl.[4] ..... B66B 1/18
[52] U.S. Cl. ..... 187/124; 187/127
[58] Field of Search ..... 187/101, 124, 127

[56] References Cited

U.S. PATENT DOCUMENTS 3,642,099 2/1972 Yuminaka et al. .
4,473,134 9/1984 Uetani ..... 187/124
4,531,616 6/1985 Uetani et al. ..... 187/124
4,542,463 9/1985 Uetani ..... 187/127 X
4,672,531 6/1987 Uetani ..... 187/124 X
4,677,577 6/1987 Takare et al. ..... 187/124 X

FOREIGN PATENT DOCUMENTS 1280702 7/1972 United Kingdom .

*Primary Examiner*—William M. Shoop, Jr.
*Assistant Examiner*—W. E. Duncanson, Jr.
*Attorney, Agent, or Firm*—Oblon, Fisher, Spivak, McClelland & Maier

[57] ABSTRACT

An apparatus for performing a group control on elevators is disclosed, by which a total operation of the elevators for respective floors of building is controlled. This apparatus includes condition-instruction table which contains a plurality of predetermined control rules being defined by given conditions and given instructions. The apparatus also includes an elevator controller for detecting, in accordance with a specific rule selected from the control rules, a degree of establishment of the given conditions to provide a detected condition, and for generating, in accordance with the detected condition, an elevator control instruction used for performing the group control.

7 Claims, 24 Drawing Sheets

| | 7 | 6 | 5 | 4 | 3 | 2 | 1 | 0 | KCT |
|---|---|---|---|---|---|---|---|---|---|
| 0 | | | | | | | | | 8D |
| 1 | | | | | | | | | 7D |
| 2 | | | | | | | | | 6D |
| | | | | | | | | | 4U |
| 11 | | | | | | | | | 5U |
| 12 | | | | | | | | | 6U |
| 13 | | | | | | | | | 7U |
| HS | | | | | D | C | B | A | FLOOR UP/DOWN |
| | | | | | CAR | | | | |

F I G. 5

| CON-DITION | DATA |
|---|---|
| TIME | |

| CON-DITION | | DATA |
|---|---|---|
| 0 | HALL CALL GENERATED | GENERATED HS |
| 1 | CAGE CALL GENERATED | CURRENT POS, GENERATED POS |
| 2 | HALL CALL CANCELLED | CURRENT HS, GET IN MEMBERS |
| 3 | CAGE CALL CANCELLED | CURRENT HS, GET OUT MEMBERS |

F I G. 6

| MON | MONTH |
|---|---|
| 0 | JAN |
| 1 | FEB |
| 2 | MAR |
| 3 | APR |
| 4 | MAY |
| 5 | JUN |
| 6 | JUL |
| 7 | AUG |
| 8 | SEPT |
| 9 | OCT |
| 10 | NOV |
| 11 | DEC |

FIG. 8A

| WEK | WEEK |
|---|---|
| 0 | SUN |
| 1 | MON |
| 2 | TUE |
| 3 | WED |
| 4 | THU |
| 5 | FRI |
| 6 | SAT |

FIG. 8B

| HDY | HOLIDAY |
|---|---|
| 0 | NOT HOLIDAY |
| 1 | HOLIDAY |

FIG. 8C

| TMB | TIME BAND |
|---|---|
| 0 | 0:00 ~ 0:15 |
| 1 | 0:15 ~ 0:30 |
| 2 | 0:30 ~ 0:45 |
| ≈ | ≈ |
| 72 | 18:00 ~ 18:15 |
| 73 | 18:15 ~ 18:30 |
| 74 | 18:30 ~ 18:45 |
| ≈ | ≈ |
| 94 | 23:30 ~ 23:45 |
| 95 | 23:45 ~ 24:00(0:00) |

FIG. 8D

| HS (POS) | HCT $ RAT | IN $ RAT | OUT $ RAT | KCT $ RAT |
|---|---|---|---|---|
| 0 (8D) | 9.5 | 5.3 | 4.2 | 2.3 |
| 1 (7D) | 1.5 | 2.0 | 1.5 | 1.3 |
| 2 (6D) | 1.8 | 1.2 | 2.0 | 1.4 |
| ≈ | ≈ | | | ≈ |
| 7 (1U) | 18.5 | 8.5 | 3.1 | 4.2 |
| ≈ | ≈ | | | ≈ |
| 12 (6U) | 2.1 | 2.0 | 1.5 | 1.2 |
| 13 (7U) | 3.0 | 1.5 | 2.0 | 1.1 |

FIG. 9

| X START FLOOR | TARGET FLOOR y | | | | | | | |
|---|---|---|---|---|---|---|---|---|
| | 1 | 2 | 3 | 4 | 5 | 6 | 7 | 8 |
| 1 | | 30.2 | 45.1 | 3.1 | 3.0 | 1.0 | 3.0 | 14.6 |
| 2 | 100 | | 5.3 | 4.1 | 4.0 | 5.0 | 4.0 | 81.6 |
| 3 | 89.7 | 10.3 | | 23.0 | 23.0 | 20.6 | 20.3 | 13.1 |
| ≈ | ≈ | | | | | | | ≈ |
| 7 | 91.5 | 2.3 | 3.2 | 1.0 | 0.5 | 0.5 | | 100 |
| 8 | 71.5 | 13.2 | 1.1 | 4.2 | 3.0 | 4.0 | 3.0 | |

KCT $ SET (x, y)

FIG. 10

| | | Δe (INCREMENT OF ERROR) | | |
|---|---|---|---|---|
| | | PB | PM | ZZ |
| e (ERROR) | PB | NE | NE | NS |
| | PM | NE | NE | ZO |
| | ZZ | NE | NS | PO |

INSTRUCTION ΔU

PO : POSITIVE ASSIGNABLE
PS : POSITIVE SMALL
ZO : NORMAL
NS : NEGATIVE SMALL
NE : NEGATIVE ASSIGNABLE

Δe
e

PB : POSITIVE LARGE
PM : POSITIVE MEDIUM
ZZ : ALMOST ZERO

| RULE | CONDITION | | INSTRUCTION |
|---|---|---|---|
| | e | Δe | Δu |
| 1 | PB | PB | NE |
| 2 | PB | PM | NE |
| 3 | PB | ZZ | NS |
| 4 | PM | PB | NE |
| 5 | PM | PM | NE |
| 6 | PM | ZZ | ZO |
| 7 | ZZ | PB | NE |
| 8 | ZZ | PM | NS |
| 9 | ZZ | ZZ | PO |

FIG. 12(b)

| HS | Tx | Tmin | Tmax |
|---|---|---|---|
| 0 | 61 | (41) | (71+10) |
| 1 | 62 | (42) | (82) |
| 2 | 1 | ( 1) | ( 1) |
| 3 | 2+10 | 2+10 | 2+10 |
| 4 | 13 | (13) | (13) |
| 5 | 14+10 | (14) | (14+10) |
| 6 | 25 | (15) | (25) |
| 7 | 26 | (16) | (26+10) |
| 8 | 27+10 | 17+10 | 37+10 |
| 9 | 38 | (28) | (48) |
| 10 | 39+10 | (29) | (49+10) |
| 11 | 50 | (30) | (50+10) |
| 12 | 51 | (31) | (51) |
| 13 | 52 | (32) | (52) |
| 14 | 53 | (33) | (53) |
| 15 | 54 | (34) | (54) |
| 16 | 55 | (35) | (55) |
| 17 | 56 | (36) | (56) |
| 18 | 57 | (37) | (57) |
| 19 | 58 | (38) | (58) |
| 20 | 59 | (39) | (59) |
| 21 | 60 | (40) | (60) |

F I G. 22(a)

| HS | Tx | Tmin | Tmax |
|---|---|---|---|
| 0 | 61 | 41 | 221+10 |
| 1 | 62 | 42 | 232+10 |
| 2 | 1 | 1 | 1 +10 |
| 3 | 2+10 | 2+10 | 12+10 |
| 4 | 13 | 13 | 23+10 |
| 5 | 14+10 | 14 | 34+10 |
| 6 | 25 | 15 | 45+10 |
| 7 | 26 | 16 | 56+10 |
| 8 | 27+10 | 17+10 | 67+10 |
| 9 | 38 | 28 | 78+10 |
| 10 | 39+10 | 29 | 89+10 |
| 11 | 50 | 30 | 100+10 |
| 12 | 51 | 31 | 111+10 |
| 13 | 52 | 32 | 122+10 |
| 14 | 53 | 33 | 133+10 |
| 15 | 54 | 34 | 144+10 |
| 16 | 55 | 35 | 155+10 |
| 17 | 56 | 36 | 166+10 |
| 18 | 57 | 37 | 177+10 |
| 19 | 58 | 38 | 188+10 |
| 20 | 59 | 39 | 199+10 |
| 21 | 60 | 40 | 210+10 |

FIG. 22(b)

| HS | TPO | TP1 | TP2 |
|---|---|---|---|
| 0 | | | |
| ⋮ | | | |
| n | | | |

| HS | Tx | Tmin | Tmax | MODE X |
|---|---|---|---|---|
| 0 | | | | |
| ⋮ | | | | |
| n | | | | |

| RULE | CONDITION | CONFIDENCE DEGREE | INSTRUCTION | VALUE OF INSTRUCTION | WEIGHTING FOR RULE |
|---|---|---|---|---|---|
| 1 | ASSIGNED CALL NUMBERS ARE LESS THAN AVERAGE VALUE | B1 | ASSIGNABLE | A1 | C1 |
| 2 | IF CAGE IS FREE | B2 | ASSIGNABLE | A2 | C2 |
| 3 | AVERAGE VALUE OF PREDICTED NONRESPONSE TIME IS LESS THAN 60 SEC | B3 | ASSIGNABLE | A3 | C3 |

FIG. 27

APPARATUS FOR PERFORMING GROUP CONTROL ON ELEVATORS

BACKGROUND OF THE INVENTION

This invention relates to a group control system of elevators and, in particular, to a group control apparatus which better follows respective target values in various types of group control.

The elevators are group-controlled primarily based on (1) car number assignment control to be made in response to a hall call and (2) special operation control to be made at the time of higher utilization demand for elevators. The aforementioned car number assignment control has been performed through an evaluation of various predicted calculation results, such as a predicted destination floor arrival time, resulting in often encountering on floor allocation failure due to the failure of an exact prediction calculation. In order to eliminate such inconvenience, some system is adapted to implement group control through the evaluation of daily traffic in elevators or through the prediction of the reliability with which prediction data is prepared. Therefore, it takes a substantial processing time to evaluate such a prediction proceeding.

This type of conventional group control is disclosed, for example, in the literatures:

(1) U.S. Pat. No. 4,499,975 (Tsuji) issued on Feb. 19, 1985; and (2) U.S. Pat. No. 4,501,344 (Uherek et al.) issued on Feb. 26, 1985.

All disclosures of the above U.S. Patents are incorporated in the present application.

In the group control to be made through learnings, it is not possible to completely predict an incidental hall call or a derivative "cage" call. In spite of this very fact, the predicted arrival time (or predicted non-response time) has been evaluated based on the assumption that such a hall call or a derivative "cage" call is made with a "100%" reliability. As a result, evaluation fault has frequently occurred in various controls being made relative to the prediction.

SUMMARY OF THE INVENTION

It is accordingly an object of this invention to provide a group control apparatus which performs group control relative to elevators in accordance with the extent of satisfaction of a basic condition under which a control instruction is to be given to various types of control targets, whereby enhanced service can be provided to passengers of the elevators by properly changing the value of the control instruction.

To achieve the above object, a group control apparatus is provided according to this invention, which apparatus is adapted to control the operations of a plurality of available elevators, in a coordinate fashion, in connection with a plurality of their destination floors. In this group control apparatus, the extent of satisfaction of respective control rules, as well as the weightings of instructions, are determined through their inference evaluation function using the control rules, with their conditions and instructions incorporated as the expert's control strategy. Then, control instructions are determined to be based on those instructions which have been weighted in accordance with the respective control rules.

Here the term "expert's control strategy" is intended to mean the practical knowledge on the group control of high efficiency, obtained through the experiences of experts well-versed in the art of group control for elevators.

The control rules represented by the associated conditions and instructions are expressed in the general form "if A, then B". For example, in the assignment control to be made in response to a hall call, "if wait long, then never assign". This is one of the control rules with their conditions and instructions as the expert's control strategy. In this way, a plurality of such control rules are prepared, which express the expert's strategy in the "if A, then B" format.

In the inference evaluation function, prediction is made for the extent to which the associated condition presented in a control rule is satisfied when a control instruction to be based on the control rule is given to the control target. Then, weighting is given to that instruction presented in the control rule on the basis of the predicted extent of the satisfaction with respect to the associated condition. For example, let it be assumed that the control rule is "if wait long, then never assign". If, at this time, a control instruction "hall call" is assigned to one of available elevators to be controlled, prediction is made for the extent to which the condition of the control rule "if wait long" is satisfied. That is, prediction is made for the extent of "wait long", through the assignment of the hall call. Based on the extent of this prediction, it is determined that a weighting be given to an "assign" instruction.

For each control rule and through the aforementioned inference evaluation function, determination is made for the extent to which the condition of the control rule is satisfied, and for the weighting of the instruction. Then, a control instruction is finally determined by a weighted instruction.

BRIEF DESCRIPTION OF THE DRAWINGS

FIG. 5 shows a data structure concerning cage condition table KCT set in group control apparatus of FIG. 1;

FIG. 6 shows the contents of communication data to be made through task 28 in FIG. 2;

FIGS. 8A to 8D show the types of learning data treated by task 27 in FIG. 2;

FIG. 9 shows one of elevator traffic modes obtained through the learning data of FIG. 8;

FIG. 10 shows another one of the elevator traffic modes to be based on the learning data in FIG. 8;

FIGS. 12(*a*) and 12(*b*) show a human judgement standard obtained through the expert's knowledge/experiment rules, which standard is utilized in the assignment control of FIG. 11;

FIGS. 22(*a*) and 22(*b*) shows predicted non-response time Tx of an elevator car for a destination floor with respect to floor sub-index HS;

FIGS. 25(*a*) and 25(*b*) show a data table associated with hall sub-index HS which is stored in a RAM in group control apparatus of FIG. 1;

FIG. 27 shows a control rule which is utilized in a first inference evaluation at step 4*a* in FIG. 26.

DETAILED DESCRIPTION OF THE PREFERRED EMBODIMENTS

Figure 1:
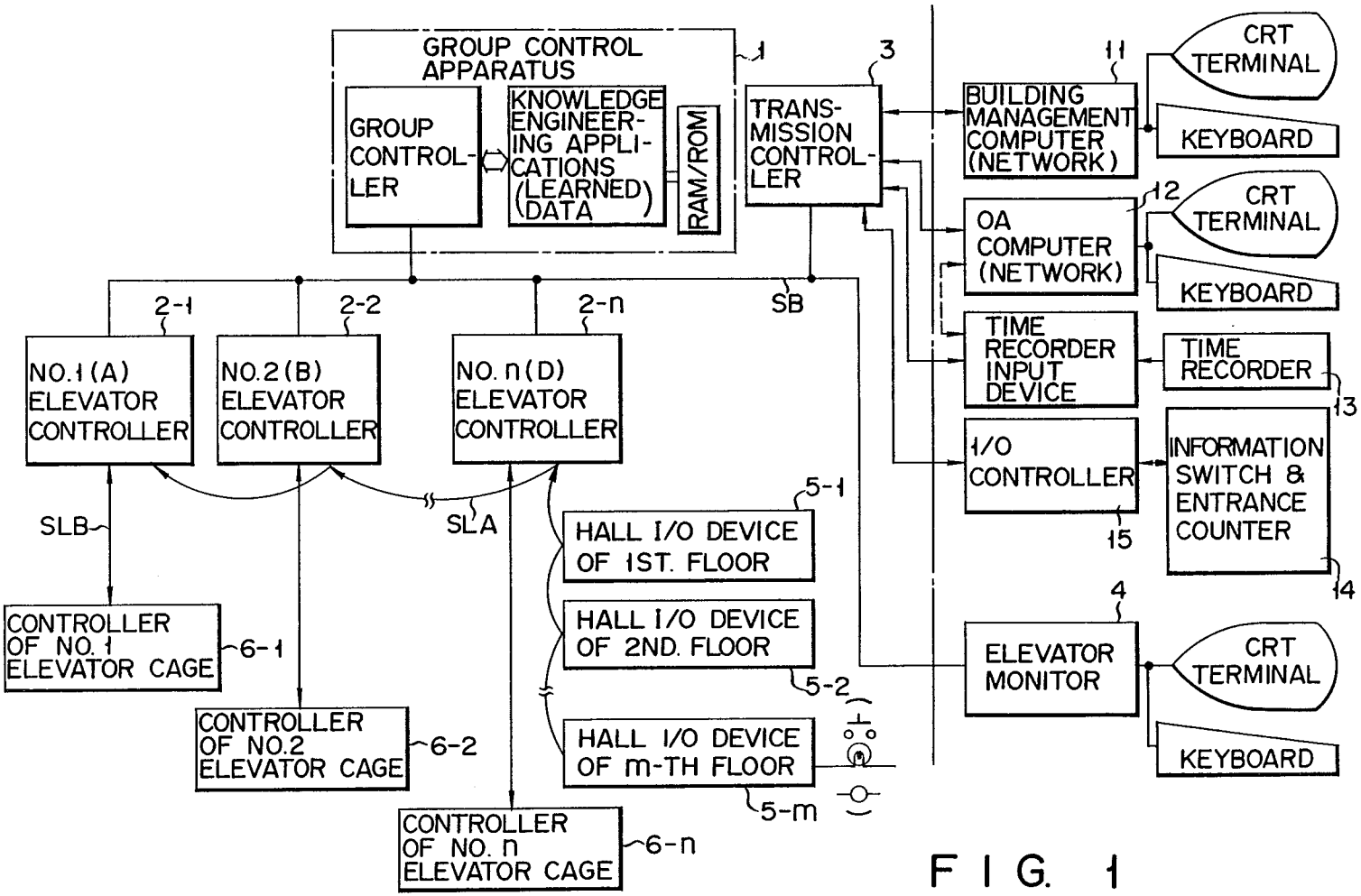
FIG. 1 is a block diagram showing a group control apparatus according to one embodiment of this invention.

An embodiment of the present invention will be described hereinafter with reference to the accompanying drawings. FIG. 1 is a block diagram showing an arrangement of a group control system according to an embodiment of the present invention.

Referring to FIG. 1, reference numeral 1 denotes a group control apparatus for controlling the overall group management; 2 (2-1 to 2-*n*), elevator controllers for controlling operations of elevator cages; 3, a transmission controller for exchanging data with an apparatus outside the group control apparatus; and 4, a monitor for monitoring the operation conditions of elevators. Group control apparatus 1 is connected to elevator controllers 2, transmission controller 3, and monitor 4 through system bus SB of a serial transmission line employing a transmission LSI. Hall I/O devices 5 (5-1 to 5-*m*) such as a gate, a lamp sensor, a display, and the like of each floor hall are I/O-coupled to elevator controllers 2 through serial transmission line SLA. This is achieved by the transmission LSI and versatile software. Controllers 6 (6-1 to 6-*n*) in elevator cages for controlling them and corresponding elevator controllers 2 (2-1 to 2-*n*) are coupled to each other through serial transmission line SLB. Data from building management computer 11; data from OA computer 12; data from time recorder 13; information data such as "in use" or "end of use" of a meeting room supplied from information switch & entrance counter 14 through I/O controller 15; and entrance counter data (data indicating the numbers of passengers entering/leaving the elevators or get in/out members) are coupled by an interface in transmission controller 3, and are transmitted onto serial system bus SB of the elevator system. Thus, various kinds of data can be supplied to group control apparatus 1, and data associated with group control can be applied to computers 11 and 12.

Note that the system illustrated in FIG. 1 corresponds to a system of nearly maximum size. For this reason, the present invention can also be applied to a system corresponding to a part of the arrangement shown in FIG. 1.

Figure 2:
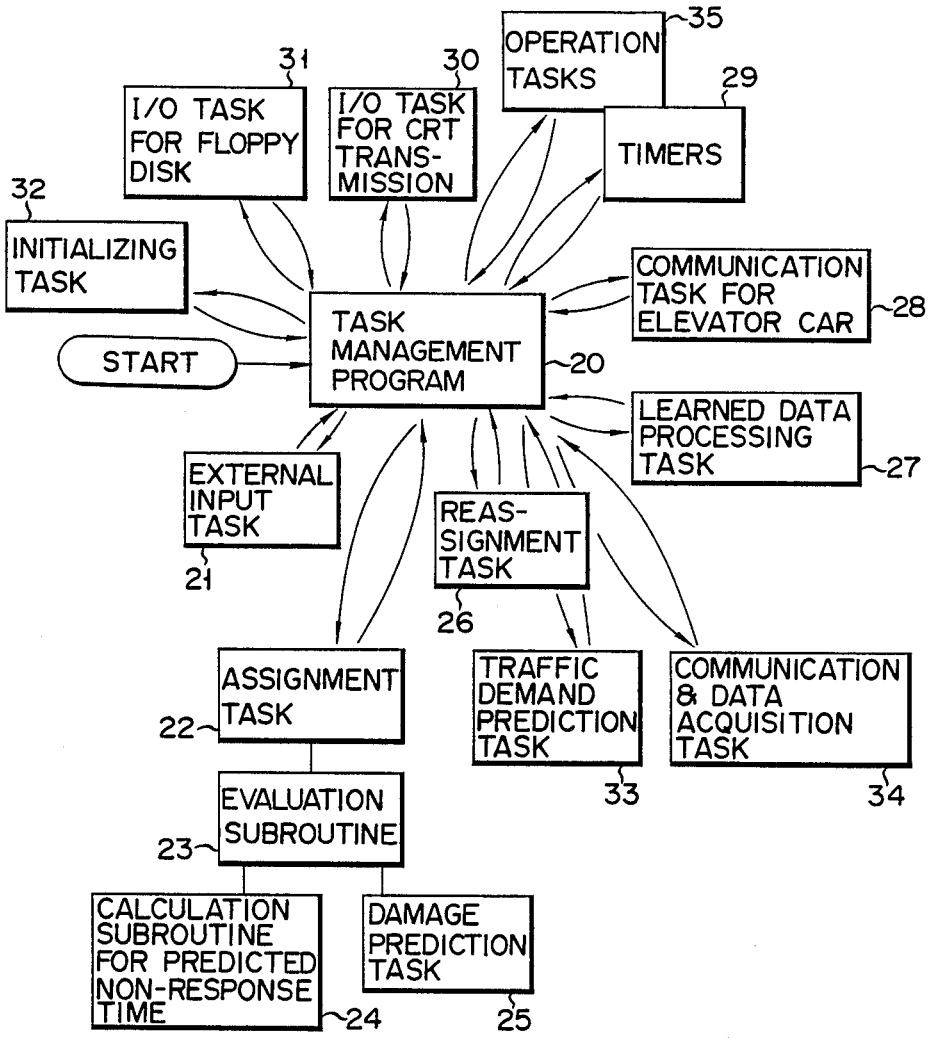
FIG. 2 is a block diagram showing an arrangement of a software for use in the group control apparatus of FIG. 1.

The software arrangement of group control apparatus 1 will now be described. The group control software is constituted by various functional tasks, their subroutines, and a task management program for managing these tasks, as shown in FIG. 2. When a small computer incorporated in group control apparatus 1 (normally, a microcomputer is employed) is started, the microcomputer executes task management program 20 to determine which of the tasks (i.e., software modules which are separated in units of functions) is to be executed. Each task corresponds to the software module of each function, and is started under conditions inherent to the task.

The tasks will be briefly described below. Reference numeral 32 denotes an initializing task. Task 32 initializes a RAM (random access memory), registers of an MPU (microprocessor), and an LSI (large scale integrated circuit) in apparatus 1. Task 32 is started under an initial condition after power-on, or it is started when an operation mode is switched.

Reference numeral 21 denotes an external input task. Task 21 is an input task for setting external inputs such as CCT, KCT, HCT, and the like (to be described later) onto the RAM. Task 21 has the higher priority than other tasks, and when task 21 is started, it is restarted every 100 ms.

During execution of this task, it is checked if the tasks are normally started.

The HCT is a hall condition table and receives registration data when a hall call is registered by an elevator controller. The CCT is a car condition table, and the KCT is a cage condition table. Assuming that a group is constituted by four elevator cars A to D and service floors are 1st to 8th floors. Then, the HCT, CCT, and KCT respectively have bit configurations as shown in FIGS. 3, 4, and 5.

Figure 3:
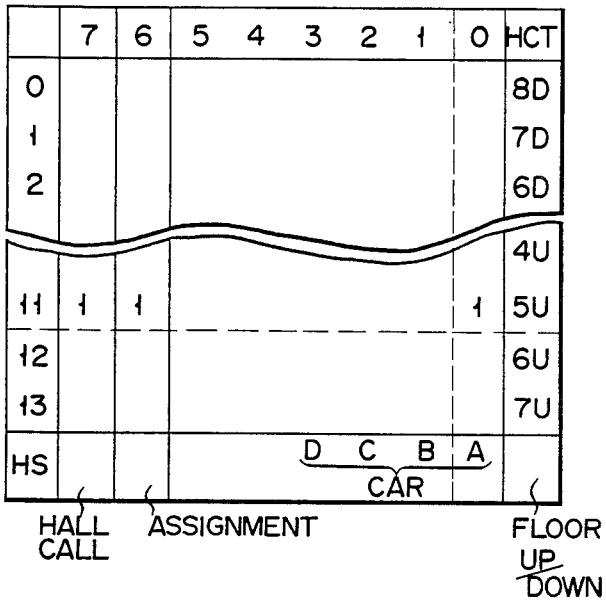
FIG. 3 shows a data structure concerning hall condition table HCT set in a RAM in group control apparatus of FIG. 1.

More specifically, in the HCT representing the hall conditions as shown in FIG. 3, 8-bit data from "downward running from the 8th floor (8D)" to "upward running to the 7th floor (7U) are stored in correspondence with hall sub-indexes (HS) "0" to "13". The hall condition for each floor will be described in detail.

For example, if an up-call hall button is depressed at the elevator hall of the 5th floor, bit 7 of HS=11 (5U) is set to be "1". When a service elevator responding to this hall call is determined to be car A by a procedure to be described later, bits 0 and 1 of HS=11 are set to be "1". When car A has arrived at the 5th floor, bits 0, 6, and 7 of HS=11 are set to be "0". More specifically, bits 0 to 3 represent cars, bit 6 represents the presence/absence of elevator assignment corresponding to the hall call, and bit 7 represents the presence/absence of the hall call.

Figure 4:
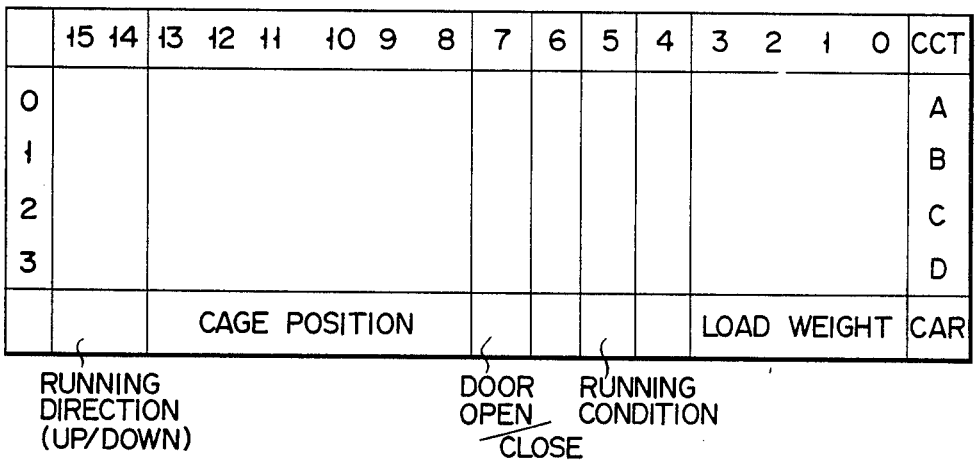
FIG. 4 shows a data structure concerning car condition table CCT set in group control apparatus of FIG. 1.

In the CCT representing the cage conditions shown in FIG. 4, 16-bit data for elevator cars A to D are stored in correspondence with indexes "0" to "3" (in the left-most column). More specifically, bits 0 to 3 represent the load weights of the cages in binary notation. When bits 0 to 3 are set to be "0001", "0010", "0011", "0100", "0101", "0110", "0111", "1000", "1001", "1010", "1011", and "1100", they respectively indicate "0 to 10%", "11 to 20%", "21 to 30%", "31 to 40%", "41 to 50%", "51 to 60%", "61 to 70%", "71 to 80%", "81 to 90%", "91 to 100%" (weight 100% indicates that the total weight of the members or passengers in the corresponding cage has reached a rated value), "101 to 110%", and "111% or more". Bit 5 represents a running condition of the cage. When bit 5 is set to be "1", it represents a running state, and when set to be "0", it represents a decelerating state. Bit 7 represents a door open/close condition. When bit 7 is set to be "1", it represents an open state, and when set to be "0", it represents a closed state. Bits 8 to 13 represent a cage position in binary notation. Bits 14 and 15 represent a running direction of the cage. When bits 14 and 15 are set to be "10", they represent an upward running direction, when set to be "01", represent a downward running direction, and when set to be "00", represent a non-direction, i.e., a stop state.

FIG. 5 shows the KCT (8 bits) representing the cage call condition. In the KCT, bits 0 to 3 represent the presence/absence of the cage call for elevator cars A to D, in the same manner as in the HCT shown in FIG. 3.

As described above, the conditions of the elevators or hall calls are input by task 21.

Referring again to FIG. 2, reference numeral 22 denotes an assignment task for cage assignment. Based on subroutines 23 to 25, task 22 checks every 100 msec whether or not a new hall call is generated. If a new hall call is generated, task 22 performs evaluation of a response impossible state (damage) on the basis of a predicted non-response time, a full capacity, and the like, and determines a car of best evaluation.

Reference numeral 26 denotes a reassignment task. Task 26 is a low-level task which is started every 1 sec. Task 26 performs reassignment for long waiting, a full capacity, or a predicted hall call.

Figure 7:
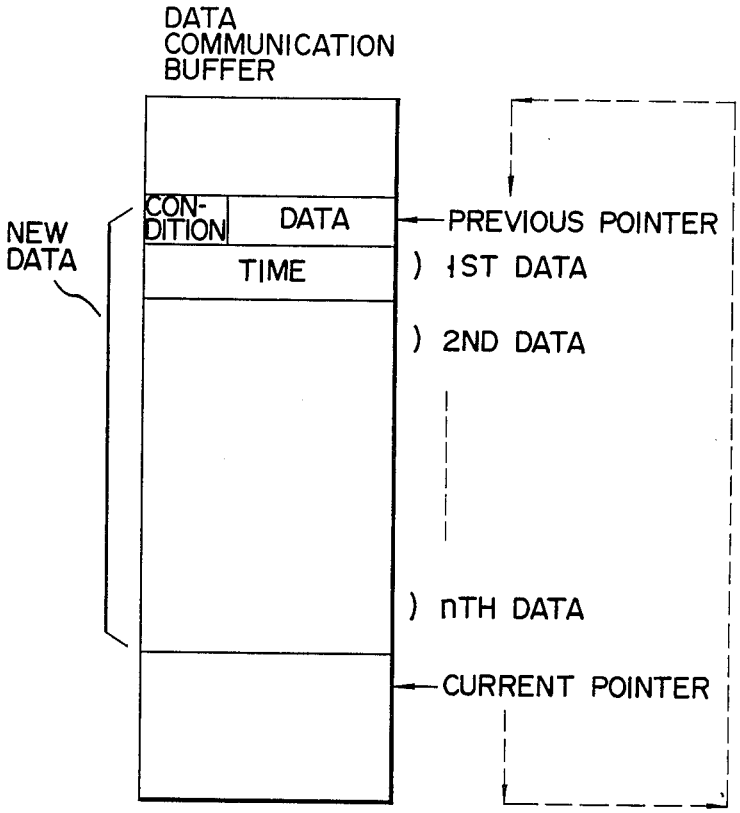
FIG. 7 illustrates transmission of data (FIG. 6) performed in a buffer memory which is utilized by task 28 in FIG. 2.

Reference numeral 28 denotes a communication task for each elevator car. In task 28, a control output (assignment or canceling of assignment), and a data request such as the number of members, the number of get in members, the number of get out members, and a new cage call are performed, as needed, as well as cyclic data transmission. These operations are performed by utilizing a buffer, and data shown in FIG. 6 are transmitted as shown in FIG. 7.

Reference numeral 29 denotes various timers corresponding to a routine of a year timer combined with various interval timers such as 10-msec, 100-msec, 1-sec timers, and the like. Timer data are corrected by an external timer, if necessary. The year timer includes month, date, day of the week, holiday, and other event data, which are updated by second I/O task 31 for a floppy disk and/or first I/O task 30 for a CRT.

First I/O (input/output) task 30 for exchanging data with a CRT (character display terminal) is used for data exchange with other terminals or computers. Task 30 is started while being time-sliced at a low-interrupt level so as not to interfere with other group control tasks.

Second I/O task 31 for controlling a floppy (flexible) disk is started when learned data is stored in an external floppy disk. Task 31 is started at a low-interrupt level in the same manner as in first I/O task 30.

Reference numeral 27 denotes a learned data processing task. Task 27 sets the current conditions in a data table in accordance with external inputs or data from elevator cars, and rewrites the data when the conditions are changed to the next ones. Task 27 is started when the data and the conditions are changed. (Read/write access of the data table of task 27 is performed by, e.g., a last-in-first-out scheme.) Task 27 is a low-interrupt level task, and is started so as not to interfere with the group control task of the high-interrupt level. However, when a special flag is set in task 27 or the priority order is changed, the interrupt level must be changed.

Learned data are classified into some traffic modes in accordance with components such as month, day of the week, holiday, time band, and the like shown in FIGS. 8A to 8D, and have the following data in units of modes.

FIGS. 9 and 10 show these data. Referring to FIG. 9, HS(Pos) corresponds to HS (left column) and HCT (right column) in FIG. 3, HCT$RAT indicates an average of hall calls, KCT$RAT indicates an average of cage calls, IN$RAT indicates an average of get in members, and OUT$RAT indicates an average of get out members, each in 15 minutes. In FIG. 10, KCT$SET (x,y) indicates a cage call generation rate for each floor (x indicates a start floor, and y indicates a target floor). HCT$RAT to OUT$RAT in FIG. 9 are represented by hall sub-indexes HS(Pos) with direction data.

KCT$RAT is indicated by an A×B matrix representing individual cage call generation rates from an A floor to a B floor.

During a high demand state, changes in HCT$RAT, KCT$RAT, IN$RAT, and OUT$RAT are learned at short intervals. The learned data are represented by AV$MENSP (HS,t) for each HS and t. In this case, t is a time.

These learned data may not be directly used in the present invention. However, since these data contribute to an improvement of precision upon execution of various prediction calculations, they are preferably used to obtain a good result. Even if no learned data is present, group control can be performed with allowable precision.

In addition to the tasks shown in FIG. 2 described above, communication & data acquisition task 34 which is started every 1 sec and performs data communication with an external computer and data acquisition, and traffic demand prediction task 33 which is started every 100 msec and predicts traffic demand by utilizing the acquired data to determine an operation model of an elevator, are provided. Furthermore, operation tasks 35 are provided as tasks for operation models started by task 33.

In the system shown in FIG. 1, group control apparatus 1 has a hall call assignment control function and a traffic model application control function by utilizing the following inference.

Note that the inference means the following method. "Confidence" of data is taken into consideration upon execution of such control, and an instruction content given by conditions including the "confidence" and a degree of decision contribution based on the instruction content are determined based on the knowledge of elevator control engineers. Then, a final instruction is determined by totally judging the instruction content and the degree of decision contribution.

Note that traffic model application control is executed as follows. For example, demand prediction such as concentration of users on a specific floor of a building for each time band or divergence from a specific floor to various floors is performed on the basis of demand condition data (including learned data) which is changed depending on a rush hour, lunch time, or weekdays, holidays, night, and the like, or data corresponding to a temporary change in demand such as a special demand of a floor where a meeting room is present (this temporary data can be obtained from, e.g., reservation in building management computer 11). Then, control suitable for a demand prediction model for meeting the predicted demand is performed. This control is performed by task 33 in FIG. 2.

Group management control according to the present invention will now be described with reference to assignment control for a hall call.

Different assignment control operations for a new hall call are performed depending on operation modes of an elevator system. For example, assignment control in an operation mode when a traffic flow at each floor is uniform (i.e., has a balanced pattern) will now be exemplified.

In an assignment control routine in the balanced pattern, the following targets are set:

(1) long waiting calls are eliminated (a long waiting call exceeding 60 sec is reduced to 0);

(2) the number of good calls is increased (the total of calls responded within 30 sec is increased);

(3) the service for a high demand floor is maintained good; and (4) passage due to full capacity is eliminated (when a load weight exceeds 80%).

Only item (1) will be described hereinafter in detail. Items (2) to (4) are similarly performed.

A control method for the above targets is on the basis of experiences and knowledges of engineers of elevator management, and is a control strategy of engineers in assignment control.

For this reason, a control rule which is represented by a condition and an instruction and is artificially determined is prepared in correspondence with each control strategy.

For example, a control rule represented by a condition and a control instruction corresponding to the target "long waiting calls is eliminated" is "if long waiting occurs, then no assignment is performed". A control rule corresponding to the target "the number of good calls is increased" is "if a call is good, then assignment is performed". For other control strategies, control rules in the form of "if A, then B" are similarly prepared.

In the present invention, a degree of establishment of a condition in the above control rule and weighting of the control instruction under this condition are determined by an inferential function for each control rule.

If the condition corresponds to "if long waiting occurs", the degree of establishment of the condition means "the degree of occasion of long waiting".

If this degree is high, this means "very long waiting occurs". On the contrary, if the degree is low, this means "not so long waiting occurs".

In the above-mentioned inference, provisional assigment is performed for a given elevator so as to predict the degree of occasion of long waiting, and the control instruction is weighted based on the predicted degree.

More specifically, when provisonal assignment is performed, if long waiting is expected to occur, the control instruction is weighted in a direction of no assigment. The weighting of an instruction determined for each control rule is totally evaluated. In the case of assignment control, a value of evaluation is obtained as a value of a control instruction meaning "assign".

The above-mentioned control is performed for each elevator car, and a hall call is assigned to a car exhibiting a maximum value.

Upon determination of assignment, assume that a large number of targets are present. In this case, if assignment of elevator cars perfectly satisfying the respective targets is to be performed, assignment cannot be performed. In this invention, therefore, assignment is performed for elevator cars which satisfy all the targets at highest degrees from the overall point of view.

For this purpose, control rules are prepared based on the above-mentioned control stratergies, and the degree of establishment of a condition and a value of an instruction are obtained, thereby determining a value of a control instruction.

A hall call assignment routine by inference utilizing direct expressions of knowledge of engineers as the characteristic feature of the present invention will now be described.

Figures 11, 12A:
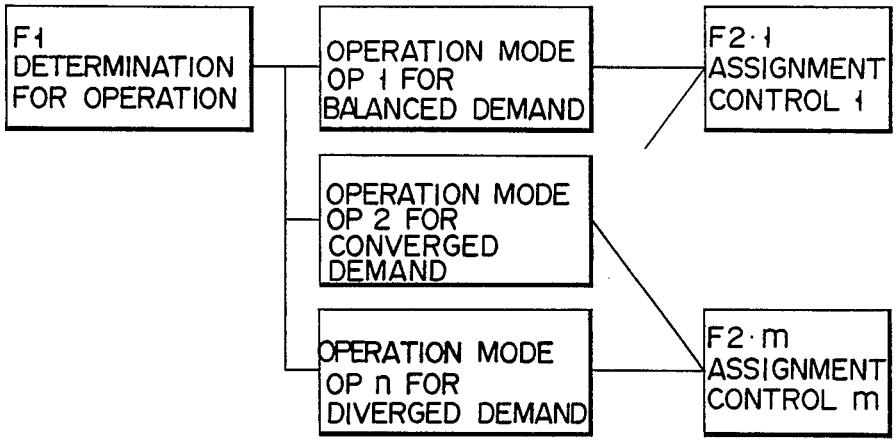
FIG. 11 is a block diagram for explaining the assignment control of an elevator car as being performed in the apparatus of FIG. 1.

FIG. 11 is a block diagram of assignment control. For the sake of simplicity, assume that three elevators (cars A to C) are subjected to group control. Floors as service objects are 1st (1F) to 12th (12F) floors.

Group control includes the following major control elements.

(i) assignment control for hall call (ii) special operation in a high demand state In item (ii), the special operation includes operation modes for converged demand, diverged demand, and balanced demand, and appropriate assignment control operations are performed for the respective modes. For this reason, according to the present invention, in operation mode determination routine F1 corresponding to item (ii) and assignment control routines F2-1 to **F2-*m* corresponding to operation modes OPl to OPn shown in FIG. 11**, control routines by means of inference using direct expressions of knowledges of engineers are employed.

In the following description, a control method will be explained with reference to assignment control F2-1 when demands are balanced.

The inference routine is the characteristic feature of the present invention, and is commonly used for Fl, F2-l to **F2-*m* in FIG. 11**. Therefore, the inference routine will first be described.

In the inference routine, output $\Delta e$ indicating whether or not an instruction is executed is determined in accordance with a ratio of error e (deviation) with respect to a target value when a provisional control instruction is executed for a given elevator car, i.e., a ratio of possibility of occasion of long waiting with respect to the target value, and increment $\Delta e$ of the error generated by the control instruction (i.e., an increment of a possibility of long waiting).

Error e and increment Δe of the error have some predicted values in accordance with a confidence degree based on a subjective evaluation of an engineer or probability data.

In the assignment control routine in the case of the balanced pattern, control for eliminating long waiting calls as a target value will be described in detail. First, whether or not target value (1) "long waiting calls are eliminated" is decreased in accordance with error e and increment Δe of the error is determined in accordance with a condition-instruction table shown in FIGS. 12(*a*) and 12(*b*). This table shows artificial descrimination standards obtained from knowledge and/or experiences of engineers. In FIG. 12(*a*), PB, PM, and ZZ are levels of e and Δe. More specifically, PB indicates "positive large", PM indicates "positive medium", and ZZ indicates "almost zero". Output Δu obtained from the table shown in FIG. 12(*a*) indicates a decision content, i.e., an instuction. More specifically, PO indicates "positive assignable", PS indicates "positive small", ZO indicates "normal", NS indicates "negative small", and NE indicates "negative assignable".

The condition-instruction table shown in FIG. 12(*a*) and a corresponding rule table shown in FIG. 12(*b*) will be described later in detail.

Figure 13:
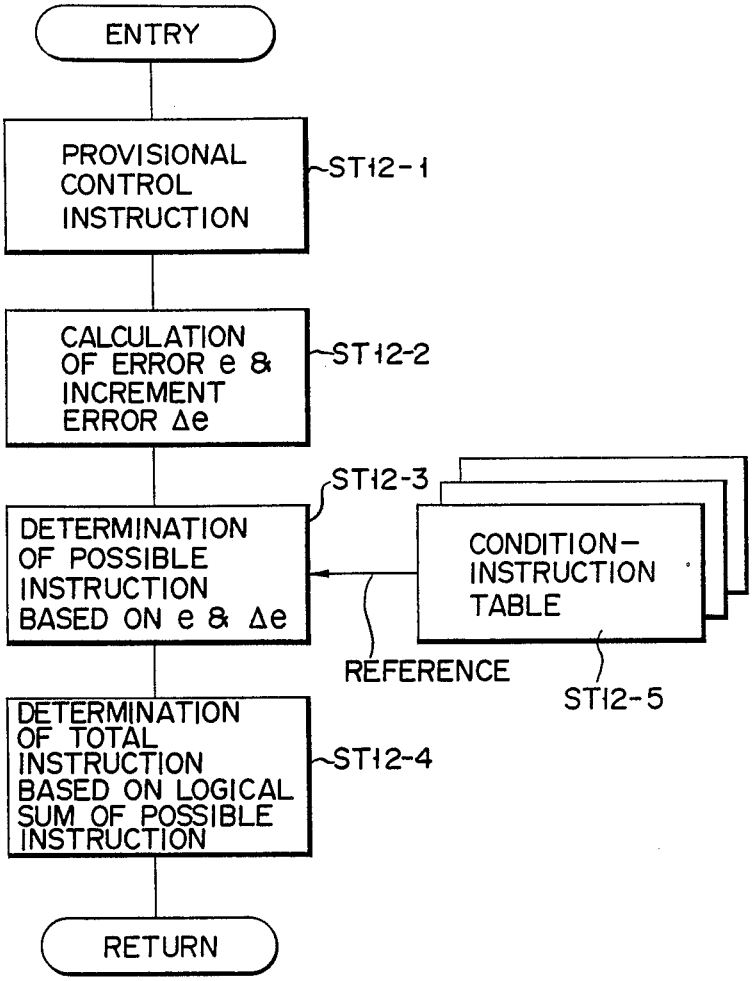
FIG. 13 shows a general flowchart representing an inference routine employed in FIG. 11.

FIG. 13 is a flow chart of an inference part. However, FIG. 13 shows a general flow chart, and each step in this flow chart is executed in accordance with a rule as an object.

More specifically, if a hall call is generated at a given floor, group control apparatus 1 shown in FIG. 1 sets a provisional control instruction for this hall call in step ST12-1. For example, assume that car A is assigned to this hall call. In the routine of step ST12-2, the number of long waiting hall calls generated for car A upon the above assignment and an increase in this number from a case wherein car A is not assigned to the call are predicted for each hall call on the basis of membership grades of data with respect to conditions of error e and increment Δe of the error.

A routine for obtaining the membership grades of data with respect to conditions of error e and increment Δe of the error will now be explained. The membership grades are calculated from predicted value (Tp2) of occasion of long waiting with respect to hall calls at respective floors (i.e., the confidence degrees of occasion of long waiting) and importance degrees (HS$W) of these floors in the system.

The importance degree in the system has the following meaning. The influence of disordered linearity of the system or prediction diability due to frequent generation of cage calls caused by long waiting at a given floor at which a high demand is predicted is taken into consideration, and the importance degree of prediction is converted to a numerical value. The importance degree may be effectively predicted from learned data such as HCT$RAT, KCT$RAT, and the like. If the learned data is not employed, a subjective evaluation or empirical value of a designer may be used as a prediction importance degree.

Figure 14A:
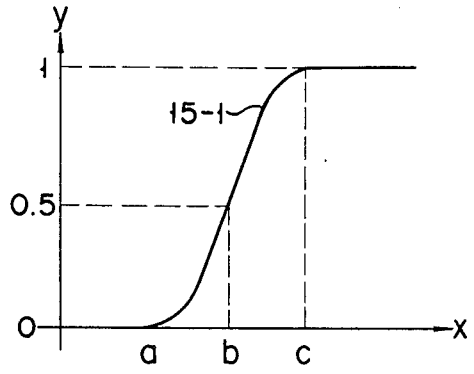
FIGS. 14(*a*) to 14(*c*) show one form of the membership function representing the possibility of a "long wait" in the assignment control of FIG. 11.
Figure 14B:
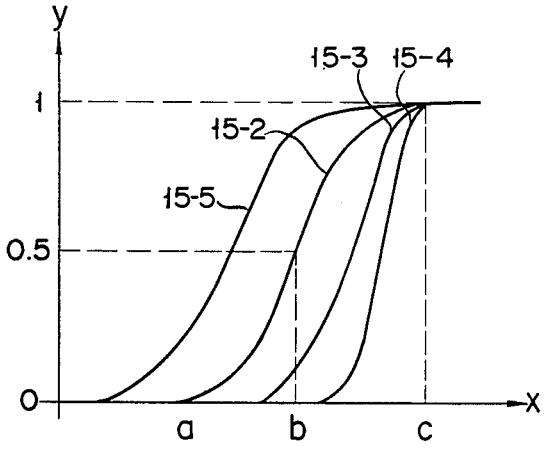
Figure 14C:
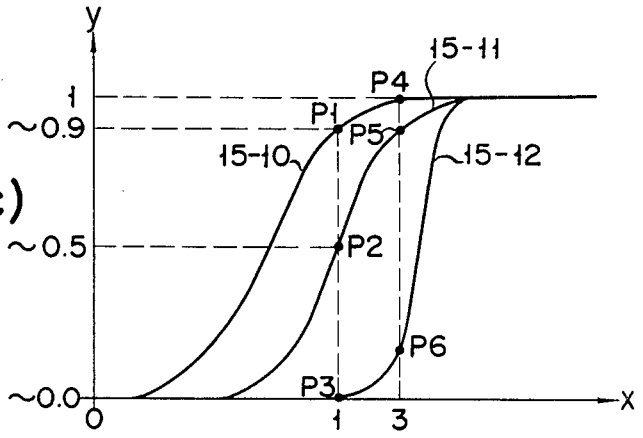

FIGS. 14(*a*) to 14(*c*) show membership functions as examples of long waiting possibility data with respect to hall call assignment.

If a membership function shown in FIG. 14(*a*) is given as S, function S can be expressed by:

$$S(x|a,b,c) = \begin{cases} 0 & \ldots x \leqq a \\ 2\{(x-c)/(c-a)\}^2 & \ldots a \leqq x \leqq b \\ 1 - 2\{(x-a)/(c-a)\}^2 & \ldots b \leqq x \leqq c \\ 1 & \ldots x \geqq c \end{cases} \quad (1)$$

where parameters a, b, and c are appropriately set in accordance with data. A ratio of the number of long waiting calls to the total of hall calls is plotted along the x axis, and the membership grade is plotted along the y axis. The form of function y changes in accordance with a value of x when a confidence degree of predicted value TP2 indicating long waiting is small (see FIG. 14(*b*)). Referring to FIG. 14(*b*), if confidence degrees K2 to K5 satisfy relation K5>K2>K3>K4, curves corresponding to K5, K2, K3, and K4 are indicated by 15-5, 15-2, 15-3, and 15-4 in FIG. 14(*b*).

The characteristic feature of this embodiment is to utilize functions 15-2 to 15-5 prepared in accordance with confidence of data. Membership function S is changed upon an increase in confidence. For example, if "confidence A" corresponds to the square of "confidence B", "confidence B" is represented by curve 15-2 and "confidence A" is represented by curve 15-5 in FIG. 14(*b*).

In this invention, the forms of the membership functions are not limited to those shown in FIG. 14. An appropriate function may be similarly employed. These function values are set beforehand in a table of the RAM in group control apparatus 1, and are used.

A method of obtaining the membership grade using long waiting possibility data (TP2) will now be described. FIG. 14(*c*) shows membership function curves 15-10, 15-11, and 15-12 in correspondence with confidence degrees 90%, 50%, and 20%. If a new hall call is generated (x=1) and a specific elevator car is provisionally assigned thereto, membership grades y are respectively about 0.9 (P1), about 0.5 (P2), and about 0.0 (P3) depending on the confidence degrees. Note that P1 to P3 are points on functional curves 15-10 to 15-12.

When three new hall calls are generated (x=3), the confidence degree of long waiting becomes higher than that in the case of x=1, and membership grades y are respectively about 0.98 (P4), about 0.85 (P5), and about 0.12 (P6). In this manner, when the confidence degree is large (curve 15-10), high membership grade y is obtained even if x is a small value. In contrast to this, if the confidence degree is small (curve 15-12), low membership grade y is obtained even if x is a large value. When calls of a plurality of confidence degrees are generated for a single car, a total of the confidence degrees is used. However, if the total of the confidence degrees exceeds 1, "1" is used as the total value.

The membership grade of predicted data is basically determined from a membership function (e.g., function S) in accor-dance with the confidence degree corresponding to a hall call. When a plurality of hall calls having different confidence degrees are generated, a membership grade of predicted data is calculated from a total value of membership grades calculated from membership functions corresponding to the respective confidence degrees. However, this embodiment does not employ this principle. More specifically, when a plurality of hall calls are generated, the confidence degrees of the hall calls are totaled to obtain total value F, and total value F is averaged by dividing with the number of hall calls. Thus, the average value is used as total confidence degree K.

$$\text{Total Value } F = \sum_{i=1}^{n} \text{Confidence Degree } Ki \quad (2)$$

$$\text{Total Confidence Degree K.} \quad (3)$$

$$(= \text{Confidence of Data}$$

$$= \text{Average of Confidence Degree})$$

$$= F/n$$

where the confidence degree represents a value of possibility that a cage arrives after 60 sec or longer (i.e., long waiting possibility data TP2), and n is the assignment.

Figure 15A:
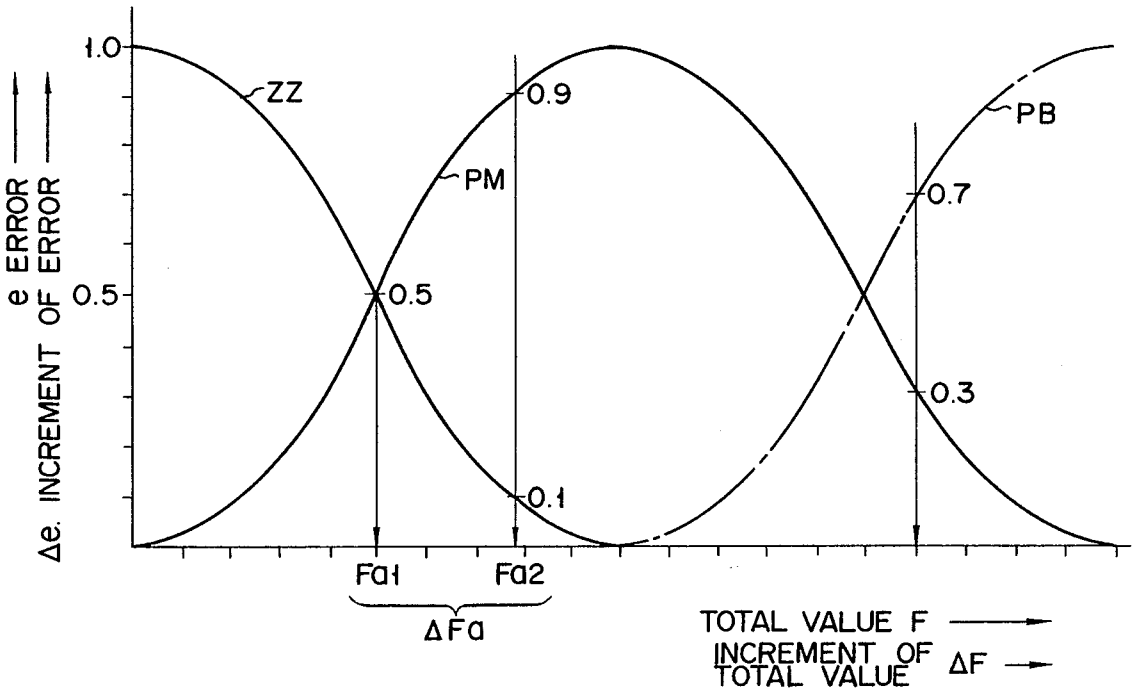
FIGS. 15(*a*) to 15(*c*) show a relation between error e as well as its increment Δe in FIG. 12(*a*), and total value F and its increment ΔF for the probability of a confidence degree with which the passenger will wait long under the assignment control of FIG. 11.
Figure 15B:
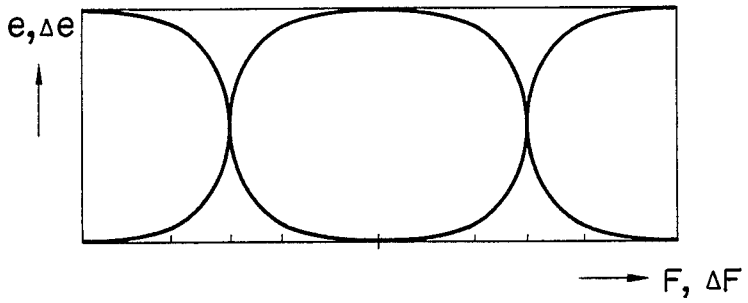
Figure 15C:
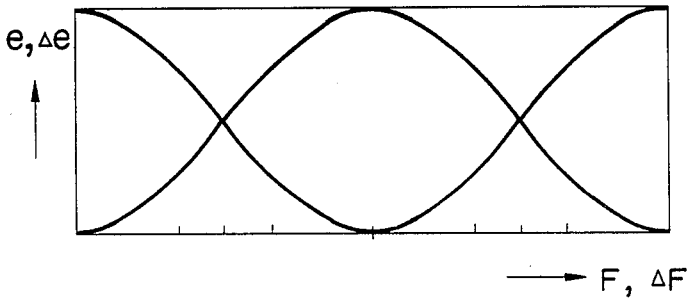

Then, error e and increment Δe of the error are obtained with respect to total confidence degree K using membership functions shown in FIGS. 15(*a*) to 15(*c*). The left half portion of curve PM in FIG. 15(*a*) corresponds to one of curves 15–2 to 15–5 in FIG. 14(*b*), for example.

Regardless of number n of hall calls, the membership functions shown in FIG. 15(*a*) artificially represent indexes such as "positive assignable", "positive small", "normal", "negative small", and "negative assignable" in association with error e and an increment of the error (cf. FIG. 12(*a*)) for every value which has a width corresponding to confidence degree K with respect to a function of total value F and increment ΔF of the total value. Therefore, the functions are set such that the function can be selected in accordance with K, and the index can be selected in accordance with F and ΔF. Therefore, when K and F are determined, the membership grade can be obtained from error e and increment Δe of the error for each index regardless of number n of hall calls.

Note that FIGS. 15(*b*) and 15(*c*) show other forms of the functions shown in FIG. 15(*a*).

When total value F and total confidence degree K for car A are obtained from equations (2) and (3), the membership function (FIG. 15(*a*)) corresponding to K is selected, and value Fa1 and Fa2 of total value F before and after provisional assignment for car A, and increment ΔFa of Fa2 with respect to Fa1 are calculated.

From the curves shown in FIG. 15(*a*), error e and increment Δe of the error corresponding to Fa2 and ΔFa are calculated. Thus, corresponding instructions (NE, NS, PO, and the like) are obtained from the condition-instruction table based on the empirical rule artificially set as shown in FIG. 12(*a*).

Assume that the membership function used in this case is as shown in FIG. 15(*a*) (however, this is an example, and is artificially selected and used), and Fa2 and ΔFa are also as shown in FIG. 15(*a*). From Fa2 and ΔFa, increment Δe of the error yields membership grade y of 0.5 for condition ZZ and yields membership grade y of 0.5 for condition PM, and error e yields membership grade y of 0.1 for condition ZZ, and membership grade y of 0.9 for condition PM.

As described above, the membership grades of the respective conditions (ZZ, PM, and the like) can be obtained.

Inference is performed based on these membership grades. Hall call assignment control by inference will now be described in detail.

In this case, target "long waiting calls are eliminated" is employed. That is, assume that "long waiting calls exceeding 60 sec are reduced to zero" is used as a target value, and a new hall call is provisionally assigned to a given elevator car. In this case, a value of possibility of long waiting is examined, and as a result, for elevator cars whose possibility of long waiting is high, assignment is suppressed. For this purpose, the strength of assignment for each car is obtained as a numerical value, and final assignment for the above-mentioned hall call is performed for a car whose strength of assignment is largest (i.e., value is highest).

Assume that three elevator cars A, B, and C are operated under group control. When a new hall call is generated, the above assignment control is performed as follows. More specifically, to which of the three cars the new hall call is to be assigned is determined by inference calculations.

First, the inference calculations of the assignment control are started by provisionally assigning the new hall call to car A.

Error e and increment Δe of the error with respect to the target value for all the hall calls including the current hall call assignment of the car, which is changed upon provisional hall call assignment, are obtained as follows.

More specifically, value Fa1 and Fa2 of a long call occasion membership grade and increment ΔFa of Fa2 from Fa1 before and after provisional assignment to car A are obtained from membership grade y for number x of long waiting hall calls, which is obtained by the method described with reference to FIGS. 14(*a*) to 14(*c*).

For example, increment ΔFa after provisional assignment obtained from value Fa1 before provisional assignment and value Fa2 after provisional assignment can be obtained from the following equation:

$$\Delta Fa = Fa2 - Fa1 \quad (4)$$

From Fa2 and ΔFa, corresponding conditions (e.g., ZZ, PM) are obtained for error e and increment Δe of the error from the condition-instruction table based on the empirical rule artificially set as shown in FIG. 12(*a*).

Assume that the membership function used in this case is as shown in FIG. 15(*a*), and Fa2 and ΔFa are also as shown in FIG. 15(*a*). From Fa2 and ΔFa, increment Δe of the error yields membership grade y of 0.5 for condition ZZ, and membership grade y of 0.5 for condition PM. Error e yields membership grade y of 0.1 for condition ZZ, and membership grade y of 0.9 for condition PM.

More specifically, when it is checked if a given object is an element of set A, it is not strictly determined to be Yes or No but the membership function as a function indicating a membership grade is used in order to take a degree of being an element of set A into consideration. This function is as shown in FIG. 15(*a*), wherein total value F and increment ΔF of the total value are plotted along the abscissa, and error e and increment Δe of the error are plotted along the ordinate. FIG. 15(*a*) exemplifies membership functions of sets ZZ, PM, and PB as sets. Set ZZ is a set of "almost zero", set PM is a set of "positive medium", and set PB is a set of "positive large".

The respective membership functions can provide degrees at which value F or increment ΔF of value F is included in sets ZZ, PM, and PB. The "degree" indicates a degree of belonging to the above sets, and is also called a membership grade. The membership grade is represented by values within the range of "0.0" to "1.0" (the ordinate of FIG. 15(*a*)).

For example, if the membership grade of an object is 1.0, the object completely corresponds to an element of set A. If the membership grade is 0.0, the object is not an element of set A.

A membership grade when value F is f will be considered below. As can be seen from FIG. 15(*a*), the membership grade of value f to set PB is 0.7, and the membership grade to set PM is 0.3.

More specifically, value f belongs to set PB of "positive large" at a membership grade of 0.7, and also belongs to set PM of "positive medium" at a membership grade of 0.3.

Note that the membership function to be used is changed depending on total confidence degree K. More specifically, if data is correct, intersection intervals of two curves are clearly separated, as shown in FIG. 15(*b*). If data is incorrect, the two curves are moderate, and the intersection intervals are made unclear, as shown in FIG. 15(*c*).

When the corresponding condition and its membership grade are obtained in this manner, a degree of a control instruction is determined from above-mentioned error e and increment Δe of the error (step ST12-3 in FIG. 13). More specifically, a new hall call is provisionally assigned, as control instruction Δu, to elevator car A as a control object. In this case, with reference to the condition-instruction table shown in FIG. 12, the strength of a hall call which is provisionally assigned to car A as normal assignment is determined (step ST12-5 in FIG. 13).

The condition-instruction table is as shown in FIG. 12(*a*), and shows the content of control instruction Δu corresponding to error e and increment Δe of the error determined based on experiences and knowledges of engineers.

For example, if error e belongs to "almost zero" (set ZZ) and increment Δe of the error belongs to "positive large" (set PB), five control instructions Δu, i.e., PO, PS, ZO, NS, and NE, are present. PO means "positive assignable", PS means "positive small", ZO means "normal", NS means "negative small", and NE means "negative assignable". The distribution of a set is artificially determined so that the content of the instruction closer to "positive assignable" is set to be a positive value, and the content of the instruction separated away from "positive assignable" is set to be a negative value.

The number of sets for error e is three, i.e., sets PB, PM, and NE, and the number of sets for increment Δe of the error is also three. Upon combinations of error e and increment Δe of the error, a total of nine control instructions Δu are available. Therefore, in this case, nine rules will be considered below.

The nine rules are determined by experiences, and are shown in FIG. 12(*b*) in detail. In FIG. 12(*b*), for example, rule 1 has the following meanings. If "error e is positively large (PB)" and "increment Δe of the error is also positively large (PB)", "control instruction Δu is not assigned (NE)".

The membership grades of value Fa2 and increment ΔFa to respective sets for provisional assignment to car A have already been calculated, and value Fa2 has a membership grade of 0.9 to set PM, and a membership grade of 0.1 to set ZZ. The membership grade of increment ΔFa to set PM is 0.5, and that to set ZZ is 0.5.

Therefore, value Fa2 belongs to sets PM and ZZ, and increment ΔFa of the value also belongs to sets PM and ZZ. When control instruction Δu is determined based on error e and increment Δe of the error, rules 5, 6, 8, and 9 in FIG. 12(*b*) are used.

Figure 16:
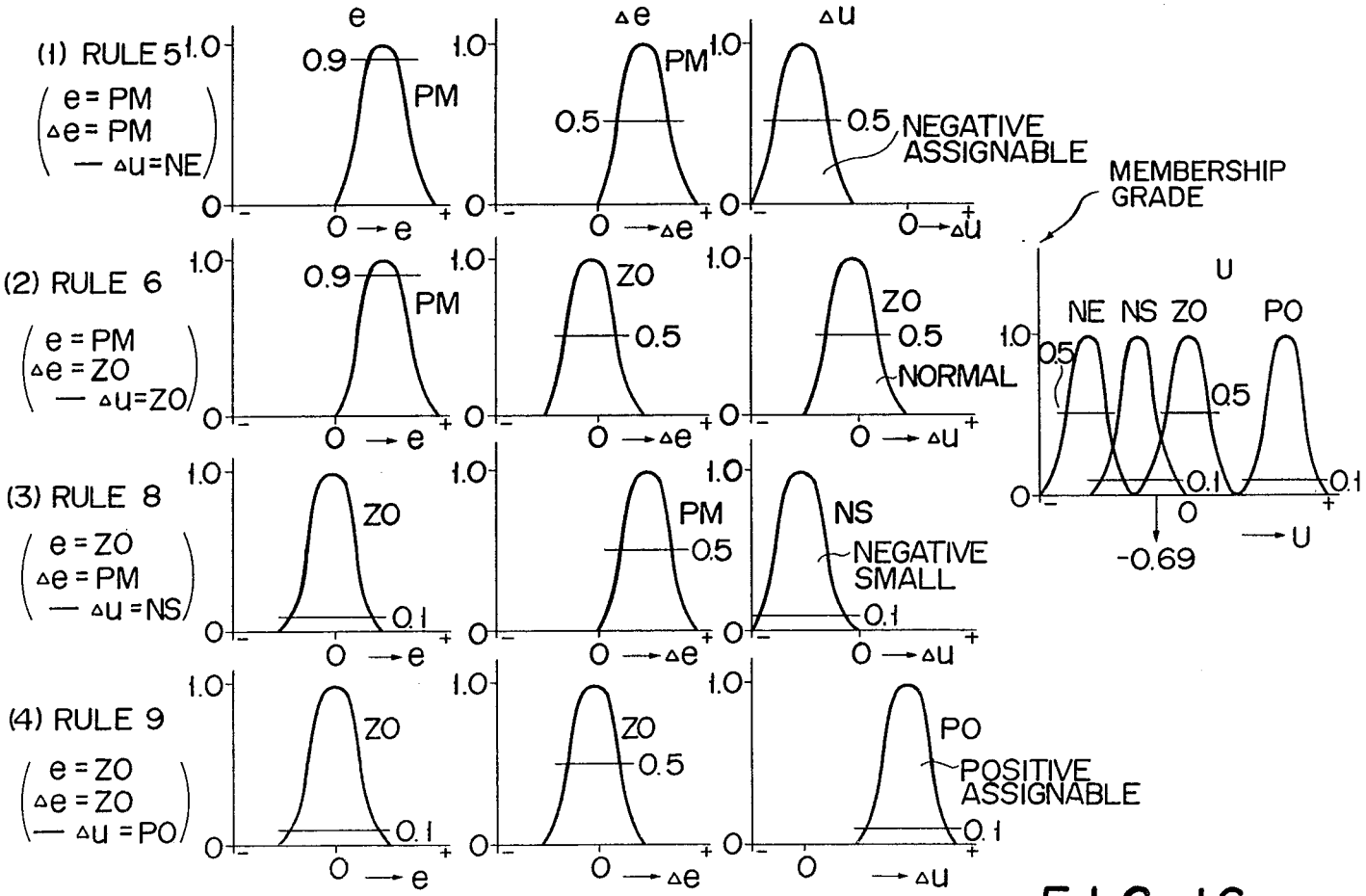
FIG. 16 is a graph showing a variation in conditions e and Δe, instruction Δu and final instruction level U corresponding to rules 5, 6, 8 and 9 in FIG. 12(*b*)

These rules are as shown in FIG. 16. As for rule 5, for error e, set PM is satisfied at a degree of 0.9, and for increment Δe, set PM is satisfied at a degree of 0.5. As the degree at which rule 5 is satisfied, a smaller one of degrees at which the two sets are satisfied is employed. Therefore, the degree of strength of control instruction Δu is restricted to 0.5.

Similarly, for rules 6, 8, and 9, a set representing control instructions Δu including the degree of strength are obtained.

In step ST12-4 in FIG. 13, a logical sum of a set of control instructions Δu obtained from the four rules is calculated, and is weighted-averaged by the degree belonging to the set, thereby obtaining strength U of a final control instruction. Control instruction Δu has a value as a distribution of a set. Therefore, as a result of weighted averaging, a strength of control as a total control direction can be obtained in accordance with weightings of four control instructions. In this case, the control instruction is regarded as a total instruction having a content "positive assignable" with respect to a hall call, as shown by the right-bottom illustration of FIG. 16. As shown in the right-side illustration of FIG. 16, the total value of strength U of the control instruction (i.e., the combination of curves NE, NS, ZO and PO) is −0.69.

Since this control instruction takes a negative value (−0.69), it means "difficult to assign". If the value of strength U is positive and is increased, it becomes easier to assign. As the value is decreased (the negative value is increased), it becomes difficult to assign.

In this manner, a strength of assignment of a new hall call to car A can be obtained.

Strengths U of assignment for other cars (B, C, . . . ) are also obtained in the same manner as described above.

The description of the inference part is thus concluded.

As described above, an instruction for each condition is obtained using the empirical rule of condition-instruction based on the knowledges of engineers, and the instruction is obtained at a degree corresponding to a ratio depending on the vagueness of the condition. A total instruction based on experiences and vagueness can be determined from the logical sum of the respective instructions. By replacing a reference table in step ST1-5 in FIG. 13, the procedure of FIG. 13 can be used in routines F1, and F2-1 to F2-*m* in FIG. 11.

Incidentally, a well-known "FUZZY Logic" can be applied to achieve the above-mentioned inference process involving a vagueness. The "FUZZY" is described in the following literature:

(i) E. H. Mamdani and S. Assilian, "An Experiment in Linguistic Synthesis with a Fuzzy Logic Controller", Int. J. Man-Machine Studies, vol. 7, pp. 1–13, 1973

(ii) Lauritz P. Holmblad and Jens-Jorgen Ostergaard "CONTROL OF A CEMENT KILN BY FUZZY LOGIC", Fuzzy Information and Decision Processes M. M. Gupta and E. Sanchez (eds.) North-Holland Publishing Company pp. 389–399, 1982

(iii) N. J. Mandic, et al., "Practical Application of a Heuristic Fuzzy Rule-based Control to the Dynamic Control of a Robot Arm" IEE PROCEEDINGS. Vol. 132 Pt. D. No. 4, pp. 190–203, July 1985

(iv) Takeshi YAMAKAWA and Katsutoshi SASAKI "FUZZY MEMORY DEVICE" Preprints of Second IFSA Congress pp. 551–555 Tokyo, July 20–25, 1987.

All disclosures of the above literature are incorporated in the present application. The "Fuzzy" device of literature (i) or (iv), for example, can be used for group control apparatus 1 in FIG. 1.

Another example of inference calculations in assignment control shown in FIG. 11 will be described with reference to again the flow chart shown in FIG. 13.

In step ST12-1, a new hall call is provisionally assigned to elevator car A to be controlled.

Then, step ST12-2 is executed. Error E from a target and increment ΔE of the error are obtained from the following equation:

$$\text{Error } E = \sum_{i=1}^{n} (\text{Predicted Non-response Time } Tx) \times (\text{Confidence Degree}) \quad (5)$$

Confidence Degree: confidence degree TP2 wherein cage will arrive after passing 60 sec n: the number of all hall calls including provisional assignment From equation (5), values of error Ea2 obtained before and after provisional assignment to car A, and increment ΔEa of error Ea2, are calculated. If the value of error E before provisional assignment is given as EaI, and error E after provisional assignment is given as Ea2. Then, increment ΔEa of error E can be obtained by the following equation:

$$\Delta Ea = Ea2 - Ea1 \quad (6)$$

Error Ea2 and increment ΔEa of the error are evaluated using the membership functions. The membership functions will be described below.

Figure 17:
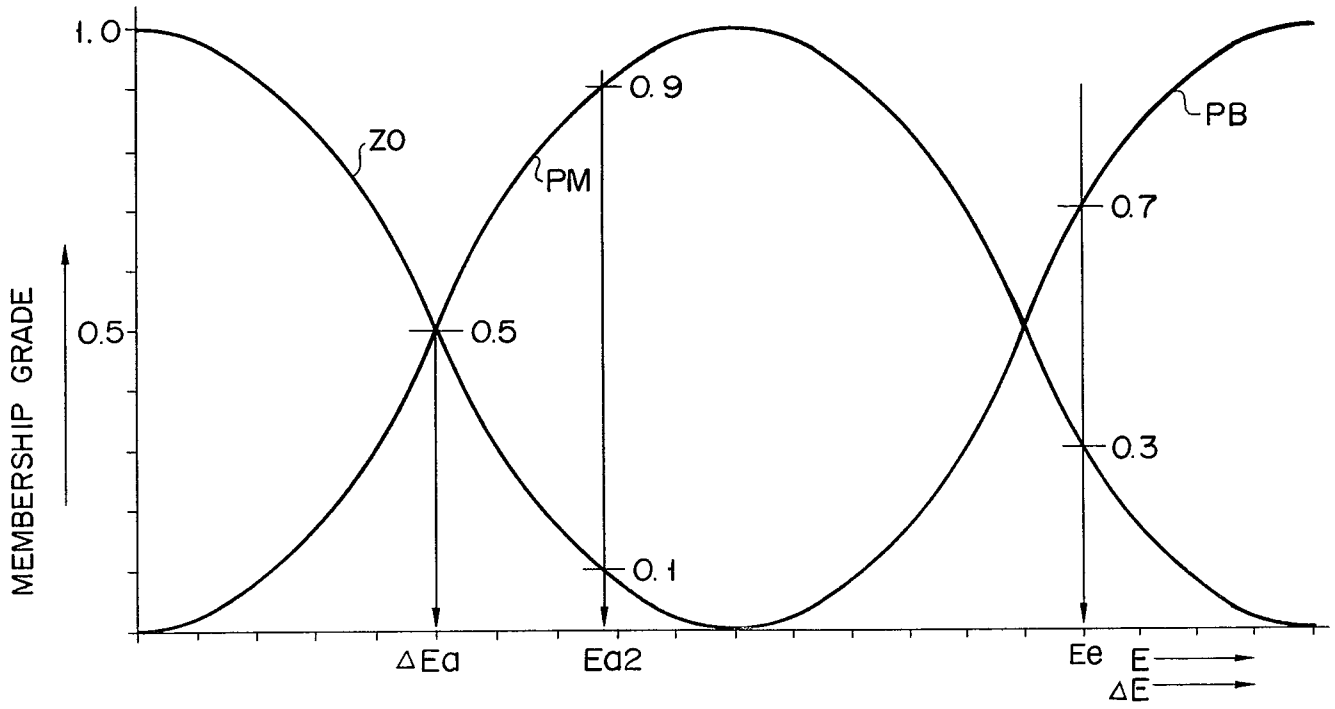
FIG. 17 is a graph showing a relation between error E with respect to a control target as well as its increment ΔE, and the membership grade under the assignment control of FIG. 11.

In general, when it is checked whether or not a given object is an element of set A, it is not strictly determined to be Yes or No, but the membership function is used to take into consideration a degree of being an element of set A. In the membership function as shown in FIG. 17, error E and increment ΔE of the error are plotted along the abscissa, and the membership grade is plotted along the ordinate. FIG. 17 shows membership functions of sets ZO, PM, and PB as sets. Set ZO is a set of "almost zero", set PM is a set of "positive medium", and set PB is a set of "positive large". The respective membership functions can provide grades at which error E or increment ΔE of the error is included in sets ZO, PM, and PB. The "grade" indicates a grade of belonging to the above sets, and is also called a membership grade. The membership grade is represented by values within the range of "0.0" to "1.0". If the membership grade is 1.0, an object completely corresponds to an element of set A. If the membership grade is 0.0, the object is not completely an element of set A.

For example, a membership grade obtained when error E is Ee will be considered below. As can be seen from FIG. 17, the membership grade of error Ee to set PB is 0.7, and the membership grade to set PM is 0.3. More specifically, error Ee belongs to set PB of "positive large" at a membership grade of 0.7, and also belongs to set PM of "positive medium" at a membership grade of 0.3.

Then, a degree of possibility for establishing a condition of a control rule is obtained. More specifically, since this condition is "if long waiting occurs", a degree of possibility of long waiting is obtained. The degree is represented by the membership grades of error E and increment ΔE of the error. Therefore, when the membership grades of error E and increment ΔE of the error are obtained, the degree of possibility for establishing the condition can be obtained.

The membership grades of error Ea2 after provisional assignment and increment ΔEa thereof are obtained from the membership functions shown in FIG. 17. As can be seen from FIG. 17, the membership grade of error Ea2 to set PM is 0.9, and the membership grade to set ZO is 0.1. The membership grade of increment ΔE of the error to set PM is 0.5, and the membership grade to set ZO is 0.5.

As described above, to which sets ZO, PM, and PB values of error E and increment ΔE of the error belong is determined taking the membership grades into account. The membership functions evaluate if the value of error E and increment ΔE of the error are large or small. More specifically, if the value of error E belongs to set PB, this means that the value is large. In addition, as the membership grade to set PB is larger, this means the value of error E is large. This applies to the value of increment ΔE of the error. Since the degree of possibility of long waiting is represented by the sets to which error E and increment ΔE of the error belong and their membership grades, the fact that error E and increment ΔE of the error are large means that the degree of possibility of long waiting is large.

As shown in FIG. 17, error Ea2 belongs to set PM at a membership grade of 0.9, and increment ΔEa of the error belongs to sets PM and ZO at a membership grade of 0.5. Therefore, this means rather long waiting occurs.

The strength of instruction shown in the control rule is determined from the evaluation results of error E and increment ΔE of the error. The evaluation results indicates that which of sets ZO, PM, and PB belongs error E and increment ΔE of the error with what membership grades.

An example of the condition-instruction table in FIG. 13 can be one as is shown in FIG. 12(*a*), provided that Δe and Δu should read as ΔE and ΔU, respectively. FIG. 12(*a*) shows instructions ΔU corresponding to error E and increment ΔE of the error. For example, if error E is "almost zero" (set ZZ) and increment ΔE of the error is "positive large" (set PB), then "negative small" is obtained as instruction ΔU. Five instructions ΔU are provided. More specifically, PO indicates "positive assignable", PS indicates "positive small", ZO indicates "normal", NS indicates "negative small", and NE indicates "negative assignable". The number of sets for ΔE is three, i.e., sets PB, PM, and NE, and that for increment ΔE of the error is also three. Upon combinations of error E and increment ΔE of the error, a total of nine rules are available. Therefore, nine rules will be considered below. The nine rules are shown in FIG. 12(*b*), provided that Δe and Δu should read as ΔE and ΔU, respectively. Rule 1 means that instruction ΔU is set to be "negative assignable" when error E is "positive large" and increment ΔE of the error is "positive large". This also applies to rule 2 and thereafter.

The above-mentioned condition-instruction table determines instruction ΔU using the sets to which error E and increment ΔE of the error belong as conditions. Thus, the condition-instruction table is a matrix of production rules represented in the form of "if A, then B". An instruction corresponding to a condition is artificially determined on the basis of a control strategy based on knowledges of engineers.

A procedure for obtaining instruction ΔU from FIG. 12(*a*) upon evaluation of error Ea2 and increment ΔEa of the error will now be described. Error Ea2 belongs to sets PM and ZZ, and increment ΔEa of the error belongs to sets PM and ZZ. Therefore, instruction ΔU can be obtained using, as conditions, the sets to which error Ea2 and increment ΔEa belong in the following four ways.

(a) If error Ea2 belongs to set PM and increment Ea belongs to set PM, instruction ΔU is NE (negative assignable).

(b) If error Ea2 belongs to set PM and increment ΔEa belongs to set ZZ, instruction ΔU is ZO (normal).

(c) If error Ea2 belongs to set ZZ and increment ΔEa belongs to set PM, instruction ΔU is NS (negative small).

(d) If error Ea2 belongs to set ZZ and increment ΔEa belongs to set ZZ, instruction ΔU is PO (positive assignable).

Four rules can be extracted from the above nine rules based on combinations (a) to (d) of the sets to which error Ea2 and increment ΔEa belong. The extracted rules are rules 5, 6, 8, and 9 shown in FIG. 12(*b*). For error Ea2 and increment ΔEa, four instructions ΔU indicated by four rules are obtained. These four instructions ΔU cannot be applied to an elevator car at the same strength. More specifically, the four instructions include ones that can be strongly applied and ones that can only be weakly applied. The instructions corresponding to the extracted rules are compared using the degrees at which the corresponding conditions of the rules are satisfied. More specifically, the instructions of the rules are weighted, and the weighted instructions are weighted-averaged to determine strength U of the instruction.

Assignment control including a routine for obtaining a predicted value of data and a confidence degree upon the above inference will be explained below.

This routine will be described with reference to predicted non-response time calculations in the hall call assignment control. The algorithm of this routine can be applied to predicted weight calculations and the like without modifications.

Figure 18:
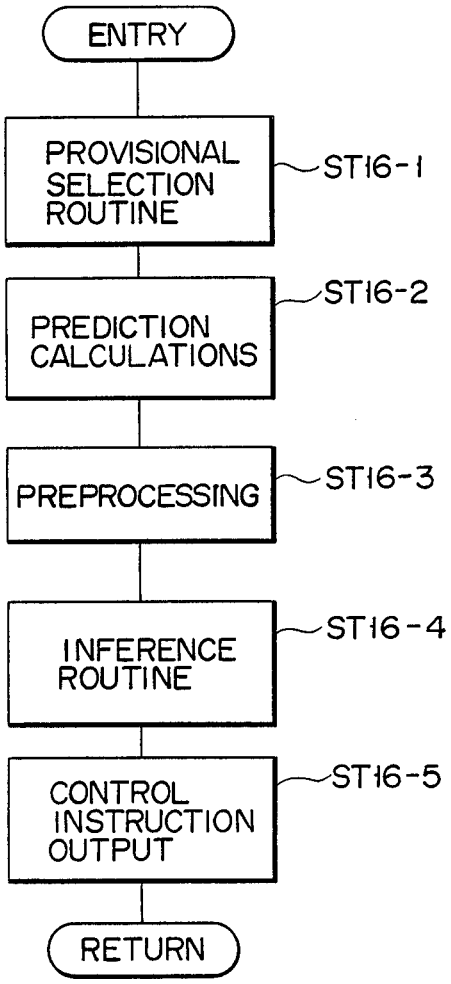
FIG. 18 is a flowchart showing a floor call assignment control in which routine step in ST16-4 represents an inference routine.

FIG. 18 shows the flow chart of the hall call assignment control routine. The inference routine described above corresponds to step ST16-4.

When a hall call is generated, and group control apparatus 1 shown in FIG. 1 detects this call, apparatus 1 enters the hall call assignment control routine (i.e., enters the flow shown in FIG. 18). First, step ST16-1 is executed to detect which elevator car is out of the group control or is in the HALT state. (That is, which elevator car cannot be subjected to hall call assignment control is detected in this step.) The elevator car, which cannot be controlled, is set to be eliminated from calculations. The flow advances to step ST16-2, and various prediction calculations are executed. In this step, prediction calculations of data, such as a predicted non-response time of each car at a target floor, a maximum non-response time, a confidence degree of the non-response time, and the like, which are necessary for the inference routine in step ST16-4, are executed, and the calculated data are used for inference.

In step ST16-4, inference data, the confidence degree, and the membership functions are utilized. Then, as described above with reference to FIG. 13, a degree, at which a condition is established, and an instruction are weighted based on various control rules representing the control strategy of engineers by conditions and instructions, thereby determining the control strengths of the control instructions for respective control rules of an elevator car to which a hall call is provisionally assigned. These instructions are weighted-averaged to obtain a degree of control strength for the corresponding elevator car with respect to an instruction content "assign" as a numerical index.

Calculations in steps ST16-2 to ST16-4 are executed for respective elevator cars. Thereafter, the strengths of control instructions of the elevator cars are compared in step ST16-5, and an instruction for finally assigning a new hall call to an elevator car, exhibiting the largest strength (highest value), is output.

New hall call assignment control is thus completed.

Figure 19:
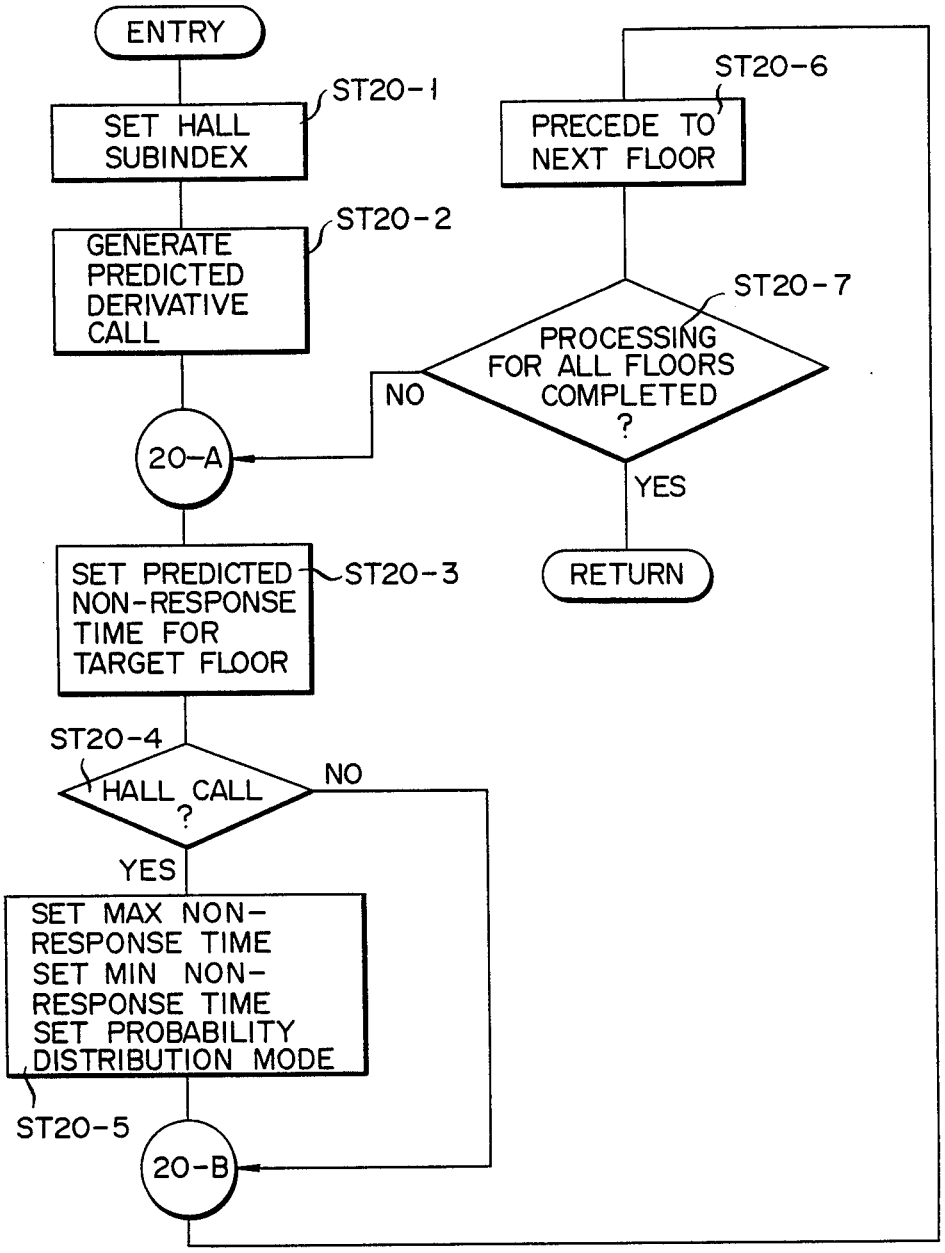
FIG. 19 is a flowchart showing a routine for evaluating the predicted non-response time of any elevator car for a destination floor, performed at step ST16-2 in FIG. 18.

FIG. 19 shows the flow chart of a predicted non-response time routine.

When step ST20-1 in FIG. 19 is executed, a hall sub-index (HS; cf. FIG. 9) corresponding to a floor where the corresponding car is present is set.

Predicted non-response time RESPT at a floor where a hall cage call is generated can be represented by the following equation:

$$RESPT(HS) = \sum_{i=1}^{l} RANT(Stai,Endi) + \sum_{i=1}^{l-1} LOST(Endi) + KEIKAT(HS) \quad (7)$$

RANT(Stai, Endi) is a running time required for running from a stop floor to the next stop floor.

LOST(Endi) is a lost time (a stay time at the corresponding floor) at a prospective stop floor. KEIKAT(HS) indicates an elapse time after assignment (assignment of the hall call) is set for hall sub-index HS for which a hall call is generated. KEIKAT(HS) can be regarded as "0", and is ignored. When KEIKAT(HS)=0, the predicted non-response time (RESPT, Tx) has the same meaning as a predicted arrival time of an elevator cage to a destination floor. l indicates the number of calls to a floor, the predicted non-response time to which is to be obtained. (The number of calls at the floor, the predicted non-response time to which is to be obtained, is also included.)

Figure 20:
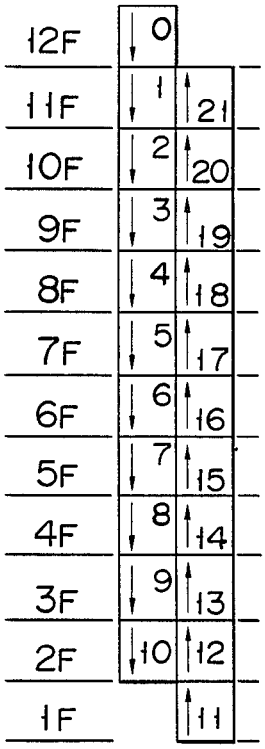
FIG. 20 shows the floor sub-indexes of step ST20-1 in FIG. 19.

FIG. 20 shows hall sub-indexes HS (0 to 21). Hall sub-index HS is determined according to the present floor where the cage is located, and to the operation direction of the cage.

For instance, an elevator presently located at the 12th floor will be described. When the cage is present at the 12th floor (12F) and is operated downward, hall sub-index HS of this cage is "0". As the cage is moved downward from the 12th floor, the value of hall sub-index HS is increased, as shown in FIG. 20. When the cage is present at the lst floor and is operated upward, hall sub-index HS of this cage is "11", and is increased as the cage is moved upward, as shown in FIG. 20. When the cage of elevator car A is operated downward from the 11th floor, for example, hall sub-index HS of this cage is "1". If hall sub-index HS of the cage is "5", the cage is now present at the 7th floor, and is operated downward. The value of hall sub-index HS indicates a start point of calculations of a predicted non-response time to respective floors in the following steps.

Step ST20-2 in FIG. 19 is then executed. In step ST20-2, a derivative cage call for the already registered hall call is generated based on the learned data and the like. The derivative cage call is a simulated call and may be different from an actual call.

Figure 21:
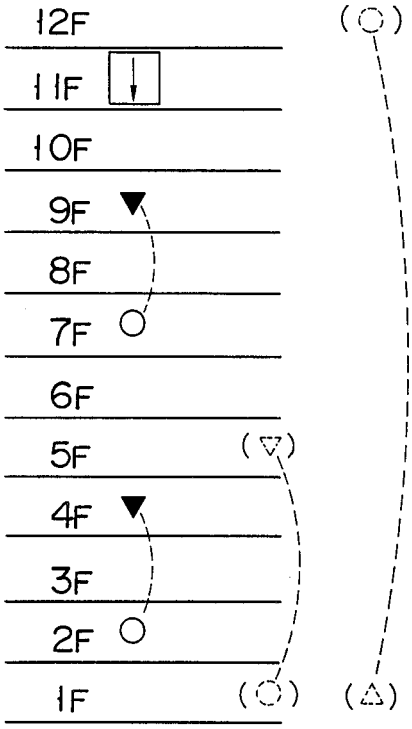
FIG. 21 shows a method for making a hall call and derivative hall call.

FIG. 21 shows a state of the hall call and the derivative call. For example, when the hall calls are generated at the 9th and 4th floors, the derivative cage calls derived therefrom are generated at the 7th floor for the hall call at the 9th floor, and at the 2nd floor for the hall call at the 4th floor. As described above, after the derivative cage calls are generated, step ST20-3 is executed.

In step ST20-3, predicted non-response times Tx at respective floors are calculated. For the sake of simplicity, calculations are performed under the assumption that only the hall call is taken into account, and no cage call is generated.

In the case of FIG. 21 predicted non-response time RESPT(3) at the 9th floor is represented by the following equation:

$$\text{RESPT}(3)=\text{RANT}(\text{Stal},\text{End1})\approx 2\ (\text{sec}) \quad (8)$$

Since no call is generated between the 11th and 9th floors, the cage is not stopped at the 10th floor. Therefore, the loss time (Lost in equation (7)) is "0". Similarly, predicted non-response time RESPT(8) at the 4th floor is expressed by the following equation:

$$RESPT(8) = RANT(Sta1,End1) + RANT(Sta2,End2) + RANT(Sta3,End3) + LOST(End1) + LOST(End2) \quad (9)$$

RANT(Sta2,End2) is a running time from the 9th floor to the 7th floor. RANT(Sta3,End3) is a running time from the 7th floor to the 4th floor. In this case, RANT(Sta2,End2) is 2 sec, and RANT(Sta3,End3) is 3 sec. LOST(End1) is a lost time at the 9th floor, and LOST(End2) is a lost time at the 7th floor. Therefore, RESPT(8) is 27 sec. In this manner, predicted non-response time RESPT(8)=Tx can be obtained.

FIG. 22(*a*) shows predicted non-response times Tx at respective floors. In this case, for the sake of simplicity, a time required for moving upward or downward between two adjacent floors is assumed to be 1 sec, and when a cage arrives at a floor at which the hole or cage call is generated, a lost time for allowing passengers to get in or out is assumed to be 10 sec. (In practice, calculations requiring higher precision is executed).

Assume that the cage is present at the 11th floor, and is moved downward. A running time from the 11th floor (hall sub-index HS is "1") to the 10th floor (hall sub-index HS is "2") is 1 sec. A running time from 11th floor to the 9th floor (hall sub-index HS is "3") is 2 sec. Since the hall call is generated at the 9th floor, the lost time is 10 sec. Therefore, it takes 13 sec from the 11th floor to the 8th floor (hall sub-index HS is "4"). Similarly, it takes 27 sec from the 11th floor to the 4th floor (hall sub-index HS is "8"). When the cage at the 11th floor is moved downward to the 1st floor, moved upward to the 12th floor, and then moved downward to the 11th floor, it takes 62 sec. This time corresponds to a case when the hall calls are generated at the 9th and 4th floors. If the number of hall calls is increased, the predicted non-response time to the respective floors is increased accordingly.

In the example of FIG. 22(*a*), demand prediction from the 5th floor (5F) at which the meeting room is present to the 1st floor (1F), and from the 5th floor to the 12th floor (12F), is performed upon calculation of predicted maximum non-response time Tmax. (Normally, time Tmax is calculated only for a floor where the hall call is generated.)

Then, steps ST20-4 and ST20-5 are executed. In these steps, for only the floor where the hall call is generated, predicted minimum non-response time Tmin, predicted maximum non-response time Tmax, and probability distribution mode MODEX (FIG. 25(*b*)) of non-response time Tx, as shown in FIG. 22(*a*), are determined. Note that FIG. 22(*b*) shows a modification of FIG. 22(*a*).

Predicted non-response time Tx represents an arrival time at each floor when a derivative call is generated for an actual hall call, and the actual hall call, its derivative call and a cage call are taken into consideration. Predicted minimum non-response time Tmin represents an arrival time at each floor obtained when only actual hall and cage calls are taken into consideration. Predicted maximum non-response time Tmax is an arrival time at each floor when hall calls are generated at all the floors and the derivative cage call prolongs the non-response time or arrival time. Predicted minimum non-response time Tmin and predicted maximum non-response time Tmax can be obtained from RESPT(HS) of equation (7) described above.

Figure 23A:
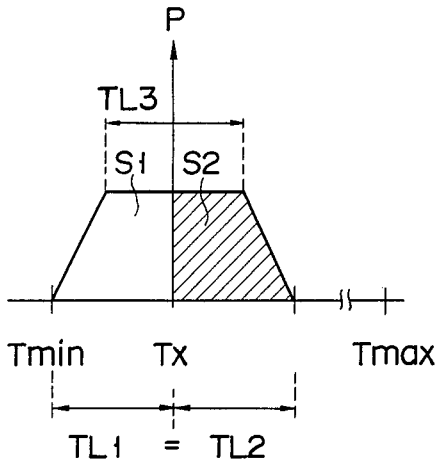
FIGS. 23(*a*) to 23(*c*) show probability distribution P of non-response time Tx of an elevator car for a destination floor.
Figure 23B:
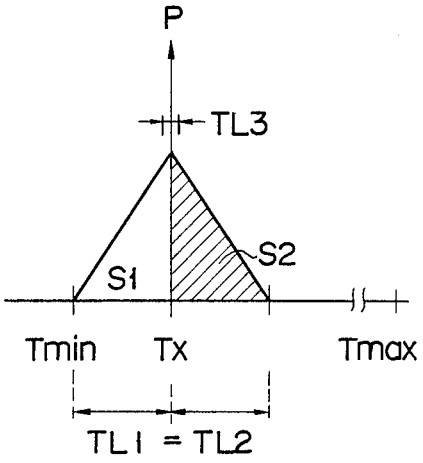
Figure 23C:
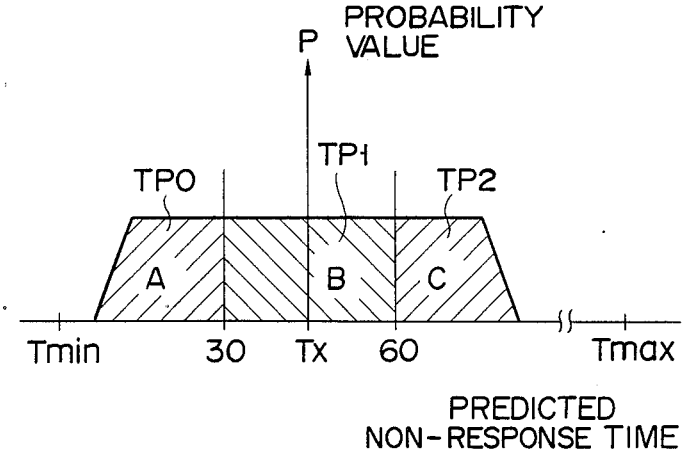

Then, the probability distribution mode of non-response time Tx is calculated. In order to calculate a possibility wherein a cage, for which a hall call is generated, arrives within a predetermined time, the probability distribution modes of floors where the hall calls are generated are set. FIGS. 23(*a*) and 23(*b*) show two probability distribution modes of non-response time of floors where the hall calls are generated. The distribution modes have predicted non-response time Tx as the distribution center. The distribution modes have different distribution states in accordance with values of predicted non-response time Tx and predicted maximum non-response time Tmax. However, the distribution modes are always present between predicted minimum and maximum non-response times Tmin and Tmax. The areas of Sl and S2 portions are equal to each other (TL1=TL2), and a sum of the areas is set to be 1.

The two probability distribution modes shown in FIGS. 23(*a*) and 23*b*) are selected depending on the possibility of coincidence between an actual cage call and a derivative cage call which is generated based on the learned data with respect to a hall call at a given floor. More specifically, if a possibility, wherein a derivative cage call generated based on the learned data coincides with an actual cage call, is low, a probability distribution mode of a pattern having long TL1, TL2, and TL3 shown in FIG. 23(*a*) is selected.

Figures 24, 25A, 25B:
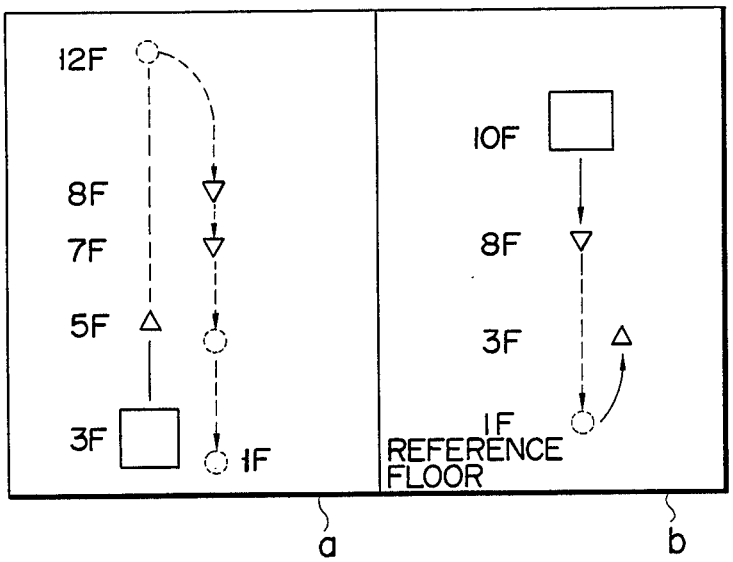
FIG. 24 explains how respective probability distributions P of FIGS. 23(*a*) to 23(*c*) are determined.

For example, assume that as shown in a of FIG. 24, as a result of response to hall call 5FUP assigned to a given car, a cage call of a target floor designated by a get in member is 12F (12th floor). Since the 12th floor is the uppermost floor, and a demand is small, the possibility wherein this cage call coincides with a derivative call of 12F is small. Therefore, probability distribution P of predicted non-response time Tx is determined to be a mode shown in FIG. 23(*a*).

More specifically, probability distribution P of predicted non-response time Tx is similarly distributed by length TL3 on both sides of data Tx of predicted non-response time RESPT in equation (7) or (9). P is distributed between minimum and maximum non-response times Tmin and Tmax. However, since Tmin is closer to data Tx of predicted non-response time RESPT, the pattern shown in FIG. 23(*a*) is selected. In order to obtain a symmetrical distribution state because we are dealing with probability, areas S1 and S2 are set to yield S1 = S2. In addition, areas S1 and S2 are normalized to yield S1+S2=1.

If the possibility of coincidence between the actual cage call and the derivative cage call generated based on the learned data is high, the probability distribution mode having short TL1, TL2, and TL3, as shown in FIG. 23(*b*) is selected. TL1, TL2, and TL3 are changed depending on its confidence. The maximum values of TL1 to TL3 are determined by the confidence. However, these maximum values are limited by Tmin and Tmax.

More specifically, in a case shown in b of FIG. 24, since a possibility of generation of a cage call at the 1st floor as a reference floor with respect to a hall call is high, the possibility wherein the cage goes to the 1st floor is increased. Therefore, the probability distribution mode of the non-response time to the 3rd floor for the cage at the 10th floor corresponds to the one shown in FIG. 23(*b*).

The confidence degree of the non-response time is calculated from probability distribution P of non-response time Tx obtained as described above. The confidence degree represents a possibility wherein a cage can arrive at a target floor within a predetermined time.

For example, the probability distribution mode of the non-response time shown in FIG. 23(*c*) will be considered. Predicted non-response time Tx is plotted along the abscissa, and probability value P is plotted along the ordinate. The possibility wherein the cage arrives within 30 sec, i.e., confidence degree TP0 can be obtained by calculating an area of portion A. Confidence degree TP1 corresponding to a possibility wherein a cage arrives within the range of 31 to 59 sec can be obtained by calculating the area of portion B. Confidence degree TP2 corresponding to a possibility wherein a cage arrives after the lapse of 60 sec or more can be obtained by calculating the area of portion C. Since the probability distribution mode is normalized so that a sum of areas=1, the confidence degrees of the respective non-response times can be obtained by calculating the corresponding areas. The confidence degree is expressed as a probability.

In the example of inference described above, since the predicted non-response time is used in the ranges of 30 sec or less, 31 to 59 sec, and 60 sec or more, the possibilities are stored in the RAM of apparatus 1 shown in FIG. 1 as TP0, TP1, and TP2, as shown in FIG. 25(*a*).

As described above, the probability distribution of the predicted non-response time to a target floor of an elevator car can be obtained. The patterns shown in FIGS. 23(*a*) to 23(*c*) are examples, and are modified in accordance with the operation state.

Data obtained as described above is set in the RAM of group control apparatus 1 shown in FIG. 1 in the form shown in FIG. 25(*b*), and is utilized as data of a possibility of long waiting.

Then, the flow advances to steps ST20-6 and ST20-7 in FIG. 19. The operations in steps ST20-3 to ST20-6 are executed for every floor. When the processing loop corresponding to all the floors is ended (i.e., YES in step ST20-7), the flow ends. This also applies to a predicted weight routine. Thus, data of a possibility associated with long waiting for each floor can be obtained.

As described above, predicted non-response time Tx and its confidence degree are obtained in steps ST20-3 to ST20-5, and the loop of steps ST20-3 to ST20-7 is repeated for every floor, thereby obtaining the confidence degrees of the predicted non-response time to each floor and the predicted non-response time to a floor where the hall call is generated.

With these data, various prediction calculations in step ST16-2 shown in FIG. 9 are completed and preprocessing in step ST16-3 is executed, so that data is prepared in the form shown in FIG. 25(*b*).

An elevator car exhibiting the highest value is detected based on the strength of assignment obtained described above, and assignment registration to an elevator controller of the corresponding car is performed so as to actually assign the hall call to the car.

Of course, when evaluation values, taking various other conditions into account, are used, a hall call may be assigned to a car with a high total evaluation value.

Another example of inference calculations shown in step ST16-4 in FIG. 18 will be described.

In the inference calculations in step ST16-4, first and second inference calculations are executed. The first inference calculation corresponds to step 4*a* in FIG. 26. In this case, a calculation for determining candidates of assignment instructions used for the second inference calculation from a plurality of assignment instructions is executed. The first inference calculation can be executed at high speed since current calculation data of each elevator car, e.g., values of the number of assigned calls, a cage condition, predicted non-response time, and the like, are used.

Figure 26:
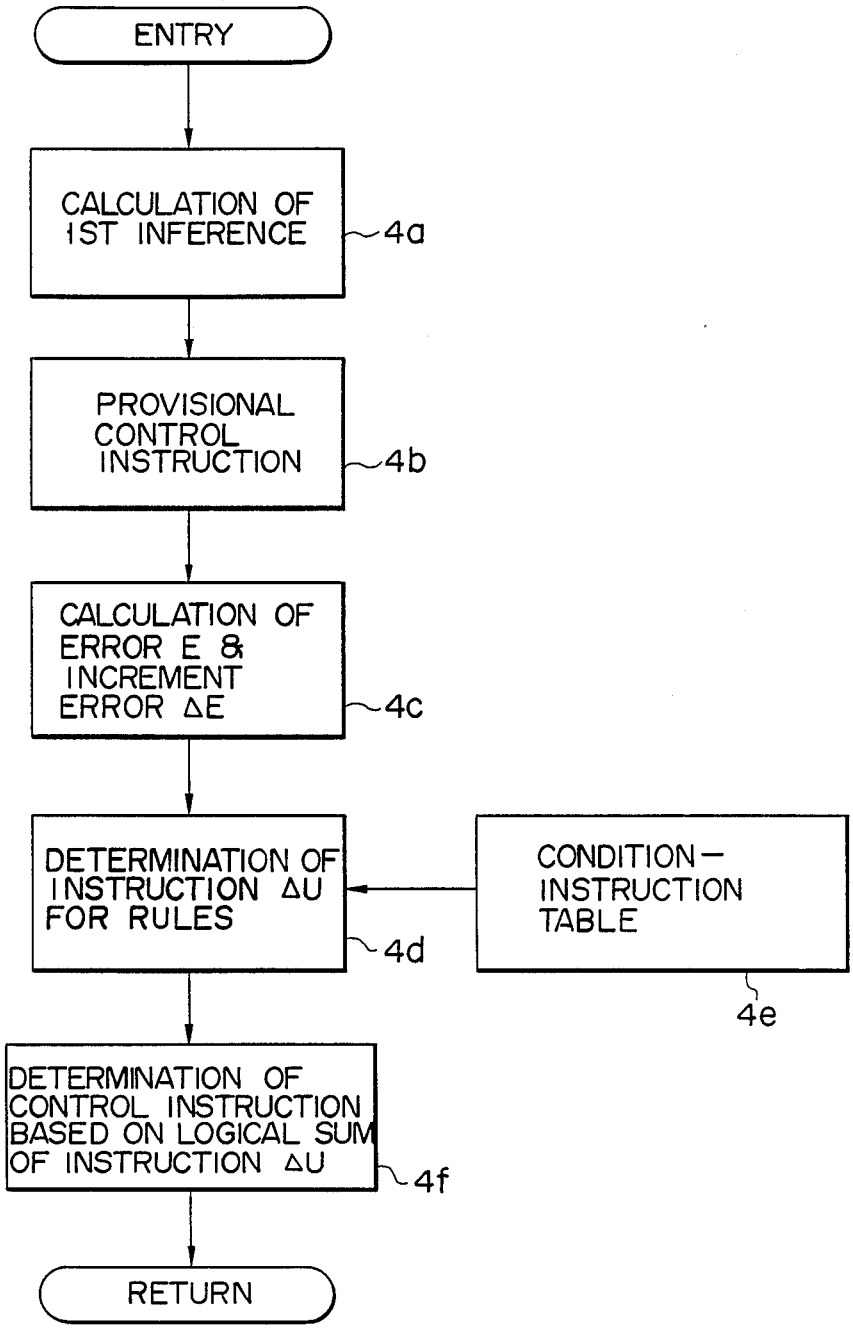
FIG. 26 shows another procedure of an inference routine in FIG. 13.

The second inference calculation corresponds to steps 4*b* to 4*f* in FIG. 26. In this calculation, a final assignment instruction is selected from the assignment instructions selected as candidates by the first inference calculation. More specifically, an elevator car to which assignment is performed is determined. (In this second inference calculation, a calculation by provisional assignment is performed, and prediction calculation necessary therefore is repeatedly executed. Therefore, the second inference calculation requires a long time.)

The inference calculations will be described with reference to the flow chart shown in FIG. 26.

In step 4*a*, the first inference calculation is executed, and candidates of assignment instructions are determined thereby. In step 4*a*, candidates of assignment instructions used in the second inference calculation executed in steps 4*b* to 4*f* are determined.

In the first inference calculation, a plurality of control rules which are expressed and weighted by conditions and instructions are used. These control rules are exemplified in FIG. 27, and already prepared calculation data are used for the first inference calculation.

For example, three different control rules will be explained below. Rule 1 shown in FIG. 27 has a content "if the number of assigned hall calls is less than an average value, the corresponding instructions are determined to be assignable". As a weight for this rule, C1 is provided. Similarly, rule 2 has a content "if a cage is free, the corresponding instructions are determined to be assignable". As a weight for this rule, C2 is provided. Rule 3 has a content "if an average value of predicted non-response times is less than 60 sec, the corresponding instructions are determined to be assignable". As a weight for this rule, C3 is provided.

The first inference calculation (step 4*a* in FIG. 26) will now be described in more detail. In the first inference calculation, elevator cars are evaluated based on rules 1, 2, and 3, and candidates of assignment instructions are determined. A case of four elevator cars, i.e., A, B, C, and D will be exemplified. First, evaluation value EA for car A is calculated by the following equation:

$$\begin{aligned} \text{Evaluation value } EA &= EA1 + EA2 + EA3 \\ &= B1 \cdot A1 \cdot C1 + B2 \cdot A2 \cdot C2 + B3 \cdot A3 \cdot C3 \end{aligned} \quad (10)$$

EA1, EA2, and EA3 are evaluation values for car A respectively using rules 1, 2, and 3. B1, B2, and B3 are confidence degrees of conditions in rules 1, 2, and 3, respectively. A1, A2, and A3 are values of instructions in rules 1, 2, and 3, respectively. In this case, for the sake of simplicity, A1=A2=A3=1. C1, C2, and C3 are weighting coefficients for rules 1, 2, and 3, respectively. For example, C1=0.7, C2=0.9, and C3=0.4.

If the number of hall calls assigned to car A is less than an average number of calls, confidence degree B1=1, and if it exceeds the average number, confidence degree B1=0. The number of assigned hall calls is obtained from a hall condition table shown in FIG. 3.

More specifically, if the number of hall calls assigned to car A is less than the average value, evaluation value EA1 of car A for rule 1 is EA1=0.7. If the number of assigned hall calls exceeds the average value, evaluation value EA1=0.

Rule 2 will be explained below. If the cage of car A is free, confidence degree B2=1. If the cage is not free, confidence degree B2=0. Whether or not the cage is free can be obtained from the car condition table shown in FIG. 4.

More specifically, if the cage is free, evaluation value EA2 of car A for rule 2 is EA2=0.9, and if not, EA2=0.

Rule 3 will be explained below. The possibility wherein an average value of predicted non-response times of car A is less than 60 sec is confidence degree B3 of the condition. The average value of predicted non-response times is obtained from the results of prediction calculations in step ST16-2 shown in FIG. 18. The possibility wherein the average value of the predicted non-response times is less than 60 sec can be obtained in step ST16-2 in FIG. 18. This possibility can be obtained in the same manner as the method for obtaining the confidence degree of the predicted non-response times from the probability distribution of the predicted non-response time. For example, if the possibility wherein the average value of the predicted non-response times is less than 60 sec is 0.6, confidence degree B3 of the condition is 0.6. Therefore, evaluation value EA3 of elevator car A for rule 3 is 0.24 (=0.6×0.4).

As described above, the evaluation values of car A for the respective rules are calculated, and finally, evaluation value EA is calculated from the above-mentioned equation (10).

Similarly, evaluation values EB, EC, and ED of cars B, C, and D are obtained by the following equations:

$$\begin{aligned} EB &= EB1 + EB2 + EB3 \\ &= B1 \cdot A1 \cdot C1 + B2 \cdot A2 \cdot C2 + B3 \cdot A3 \cdot C3 \end{aligned} \quad (11)$$

$$\begin{aligned} EC &= EC1 + EC2 + EC3 \\ &= B1 \cdot A1 \cdot C1 + B2 \cdot A2 \cdot C2 + B3 \cdot A3 \cdot C3 \end{aligned} \quad (12)$$

$$\begin{aligned} ED &= ED1 + ED2 + ED3 \\ &= B1 \cdot A1 \cdot C1 + B2 \cdot A2 \cdot C2 + B3 \cdot A3 \cdot C3 \end{aligned} \quad (13)$$

The three elevator cars are finally selected in the order of evaluation values EA, EB, EC, and ED, and assignment instructions corresponding to the selected elevator cars are determined as candidates. For example, if cars A, B, and C are selected from the four elevator cars through the above calculations, corresponding assignment instructions "assign to car A", "assign to car B", and "assign to car C", are selected as candidates of assignment instructions.

In the first inference calculation, candidates of assignment instructions are determined in accordance with the states of elevator cars using a plurality of control rules. More specifically, appropriate assignment instructions as an object of assignment control are selected in accordance with the states of elevator cars, e.g., values of the number of assigned calls, the state of cage, predicted non-response times, and the like. In the above description, three rules are employed. However, more than three rules can be employed. Each rule is expressed by a condition and an instruction, and is weighted. The conditions and instructions are determined based on the control strategy of engineers, and the value of the instruction and weighting for each rule are also determined based on the control strategy of engineers.

In the first inference calculation, assignment instructions corresponding to three elevator cars having larger evaluation values are selected from the four assignment instructions as the candidates of the assignment instructions. However, the number of elevator cars is not limited to 3. The number of candidates is determined by the control strategy of engineers.

The second inference calculation (steps 4*b* to 4*f*) will now be described. In the second inference calculation, the inference calculation is executed based on three assignment instructions selected as candidates in the first inference calculation.

In the second inference calculation, the calculation of assignment control is executed. In this assignment control, a target "long waiting calls are eliminated", i.e., "long waiting calls exceeding 60 sec are reduced to zero" is employed. Thus, when a new hall call is provisionally assigned, an elevator car having a high possibility of long waiting is set to be difficult to assign. More specifically, upon provisional assignment, the strength of an instruction "assigned to hall call" is expressed by a numerical value using deviation (to be referred to as error hereinafter) E from the target and increment ΔE of the error. The strengths of instructions of the elevator cars corresponding to the three assignment instructions are calculated. More specifically, the calculation is performed for cars A, B, and C.

The second inference calculation of the assignment control will be described with reference to the flow chart shown in FIG. 26.

In step 4b, a control instruction "a new hall call is provisionally assigned" is supplied to car A of cars A, B, and C.

Then, step 4c is executed. Error E from the target is calculated from equation (5) described above.

The values of error Ea2 and increment ΔEa of the error are evaluated using the membership functions. The evaluation is performed in the same manner as that described with reference to FIG. 17, and a detailed description thereof will be omitted.

As described above, four rules are extracted from the above-mentioned nine rules upon combinations (aforementioned four ways (a) to (d)) of sets to which error Ea2 and increment ΔEa belong. The extracted rules are rules 5, 6, 8, and 9 shown in FIG. 12(*b*). Four instructions ΔU shown in four rules are obtained for error Ea2 and increment ΔEa. These four instructions cannot be applied to elevator cars at the same strength. More specifically, these four rules include ones that can be strongly applied and ones that can only be weakly applied. The instructions corresponding to the rules are compared by the degrees at which the conditions of the rules are satisfied. More specifically, instructions of the rules are weighted, and the weighted rules are averaged to determine strength U of the instruction.

Explanation will be given about the value of an instruction, as obtained through the weighting of instructions of respective rules and through the averaging of such weightings, by referring to FIG. 16.

With e, Δe and Δu put as E, ΔE and ΔU, respectively, in the plot of error E against its increment ΔE in FIG. 16, the abscissa shows error E or its increment ΔE and the ordinate the extent of membership grade. In the plot of instruction ΔU in FIG. 16, the abscissa shows "assignable" in the positive-going direction and "unassignable" in the negative-going direction and the ordinate shows the grade of membership.

With respect to Rule 5 in FIG. 16, a set PM is satisfied at a level of 0.9 against error E, and at a level of 0.5 against error increment ΔE. Rule 5 is satisfied at the smaller one of both sets for E and ΔE. Thus, it is evident that Rule 5 is satisfied at the level of 0.5. The set representing instruction ΔU is restricted by 0.5. The set representing instruction ΔU is similarly evaluated for Rules 6, 8 and 9. In this way, step 4d in FIG. 26 is ended.

Then, step 4f in FIG. 26 is carried out. At step 4f, a logical sum of instruction sets is taken for respective Rules as obtained at step 4d, and a corresponding weighted average is taken with respect to the levels to which the sets belong, finally finding level U of the instruction. Here level U of the instruction is −0.69 as shown in the right side of FIG. 16. Level U of the aforementioned instruction denotes the level of a weight taken with respect to an instruction "never assign" in the Control Rule "If wait long, then never assign".

Although this invention has been explained in connection with determining the extent of the satisfaction of the condition in Control Rule "if wait long, then never assign", as well as the weight of an instruction, the extent of such satisfaction and weight of other instructions are similarly determined, through a similar inference evaluation, for other Control Rules. In this way, the value (or level) of the control instruction is determined by the weight of the instruction, that is, by level U of the instruction, as found for respective Control Rule. Here the term "control instruction" used in the above explanation is intended to mean that "a hall call is assigned to No. A elevator car". Similarly, the value of an assignment instruction "a hall call is applied to No. B elevator car" is determined for No. B elevator car, No. C elevator car, . . . If, in this way, step 4f is ended and, at the same time, inference step ST16-4 in FIG. 18 is completed.

In the flowchart of FIG. 26, it is only an elevator car, supplied with an assignment instruction by first inference evaluation 4a, that requires a second inference evaluation (4b to 4f). Since it is not necessary to perform such a second inference evaluation for all the remaining elevator cars, a required inference evaluation time can be made shorter than in the flowchart of FIG. 13.

The relation of the membership grade (FIG. 17) to error E and instruction ΔU (equivalent to Δu in FIG. 12), which is employed in the inference evaluation for assignment control, is artificially determined.

That is, the membership function is determined by the expert's rule-of-thumb method. Which of instructions should be employed for error E and its increment ΔE is also determined by the expert's rule-of-thumb method. As a result, it is possible to perform an inference operation through the direct expression of the expert's rule-of-thumb method for assignment control, thus assuring an exact assignment. It is very difficult to exactly perform an assignment evaluation on the mathematical formulas due to random occurrence of off-normal hall calls. As represented by the aforementioned inference evaluation, with various types of data thus weighted, exact assignment control can be carried out through the direct expression of the human's rule-of-thumb method.

Since a predicted non-response time is considered with the confidence degree for the assignment to be carried out, an elevator car of a higher confidence degree can be assigned even during the same predicted non-response time, thus reducing the occurrence of "wait long".

According to this invention, since the expert's direct algorithm expression is prepared with the use of a simple evaluation equation, such as Equation (10), for the control instruction to be carried out, the accuracy with which the aforementioned prediction is carried out is readily improved and, furthermore, the group control apparatus can fastly and readily be applied to various types of buildings, equipped with elevators of different traffic, with additions and modifications of the control rules possible as the expressions of the algorithms. For the group control of the elevators the following goals are considered:

(1) to decrease "long wait" calls, thereby reducing the possibility of exceeding the predicted non-response time over, e.g., 60 seconds;

(2) to increase "good" calls, thereby enhancing the possibility of falling the predicted non-response time under, e.g., 30 seconds;

(3) to decrease "longest wait" calls, thereby decreasing the predicted maximum non-response time;

(4) to keep "higher demand" floors in a readily available state;

(5) to decrease "non-response of not-really full-weighted cage" conditions;

(6) to decrease "cage calls" of an improper priority level; and 7) to increase "fast calls", thereby increasing the available number of cages which can respond to its calls with the minimum non-response time.

In the assignment control of the group control apparatus, the aforementioned inference evaluation routine is expressed, for the respective goal, in a list format, and only a required portion of it is employed on a given operation model. In the list format as shown in FIG. 7, subsequent data is designated by the pointer, and additions and modifications are readily implemented through the connection via the pointer.

In the group control on the elevators, the operation mode is determined in accordance with the traffic demand level so as to increase that transportation capacity. As shown in FIG. 11, as the operation mode use may be made of a divergence model ($OP_n$), convergence model ($OP_2$), balanced mode, etc. According to this invention the aforementioned inference evaluation can be employed even in determining the switching operation from one from another operation mode. The predetermined assignment control can be performed, for the respective operation mode, through the inference evaluation in which case the goal of the respective assignment control is selected from the aforementioned goals or targets (1) to (7).

This invention can also apply to the determination of the operation mode through the modeling of the macro and micro flow of traffic which is involved in high, cyclic convergence and divergence demand as at an up-peak and "lunch time" hour, as well as in a temporary high demand for a conference room, for instance.

As set forth above, according to this invention, the inference evaluation is made through the utilization of the direct expression of experts rule-of-thumb on their knowledge to implement the group control. Furthermore, the control level is properly varied in view of the degree of vagueness with which the aforementioned rule-of-thumb is established. (Such vagueness can be handled by said Fuzzy logics, for example.) Because of the fine group control thus attained and because the data's vagueness is employed as such a level, there is less assignment failure and hence ideal control can be implemented. Moreover, the inference evaluation is made in view of the effect of the system upon the respective floor, and the direct micro control instruction emerges as a finely-controlled instruction.

This invention is not restricted to the aforementioned embodiments and can properly be varied in a variety of ways without departing from the scope of this invention. Although this invention has been explained in connection with the assignment control scheme, the rule-of-thumb inference routine can be employed for a special operation select routine for a high demand requirement, assuring a minute control operation. This can be done by classifying the traffic demand into a convergence demand, divergence demand, and balanced demand involving the former two demands. Then, a demand level and its duration time are predicted on the basis of macro data, such as the learning data, as well as micro data thus currently acquired, so that a proper confidence degree is obtained and a selection of the rules is determined through an inference evaluation scheme of the type as set forth above.

As one practical form of application, the system of this invention can be made of a self-growth type through the direct expression of the rule-of-thumb method, whereby additions and modifications can be made through its own self-growth scheme made in view of good and bad results involved. This assures a higher performance group control system.

According to this invention, the group control of high efficiency can be implemented by determining the extent of satisfaction of a plurality of control rules with their conditions and instructions incorporated as the expert's control strategy, as well as by determining the respective weight of the instruction, and further by determining control instructions, for group control, with the use of the instructions which have been weighted for the respective control rules.

According to this invention, it is possible to employ divided inference functions. In this case, prior to performing a second inference evaluation through a first inference function, the control instruction candidate or candidates can be restricted to some of all the elevator cars, thus reducing the inference evaluation time required.

What is claimed is:

1. An apparatus for performing a group control on elevators, by which a total operation of the elevators for respective floors of building is controlled, said apparatus comprising:

condition-instruction table means for providing a condition-instruction table which contains a plurality of predetermined control rules being defined by given conditions and given instructions; and elevator control means, coupled to said condition-instruction table means, for detecting, in accordance with a specific rule selected from said control rules, a degree of establishment of said given conditions to provide a detected condition, and generating, in accordance with said detected condition, an elevator control instruction used for performing said group control.

2. An apparatus for performing a group control on elevators, by which a total operation of the elevators for respective floors of building is controlled, said apparatus comprising:

condition-instruction table means for providing a condition-instruction table which contains a plurality of predetermined control rules being defined by given conditions and given instructions; and elevator control means, coupled to said condition-instruction table means, for detecting, in accordance with a specific rule selected from said control rules, a degree of establishment of said given conditions to provide a detected condition, for weighting by a given weighting coefficient said given instruction to provide a weighted instruction, and for generating, in accordance with an evaluation value determined by a combination of said detected condition and said weighted instruction, an elevator control instruction used for performing said group control.

3. An apparatus according to claim 1 or 2, wherein said given conditions and said given instructions are experimentally determined in accordance with data of actual operation of elevators.

4. An apparatus according to claim 2, wherein said elevator control means includes a Fuzzy device used for detecting the degree of establishment of said given conditions.

5. An apparatus according to claim 2, wherein said elevators include at least first and second elevator car controllers, and said elevator control means has functions of:

(a) provisionally assigning a hall call instruction to said first elevator controller, said hall call instruction being generated by a user or passenger of the elevators;

(b) with respect to said first elevator controller, obtaining a first evaluation value from said detected condition and said weighted instruction;

(c) provisionally assigning said hall call instruction to said second elevator controller;

(d) with respect to said second elevator controller, obtaining a second evaluation value from said detected condition and said weighted instruction; and (e) assigning said hall call instruction to said first elevator controller when said first evaluation value exceeds said second evaluation value, and assigning said hall call instruction to said second elevator controller when said second evaluation value exceeds said first evaluation value.

6. An apparatus according to claim 1 or 2, wherein said elevators include at least first and second elevator car controllers, and said elevator control means has functions of:

(a) provisionally assigning a hall call instruction to said first elevator controller, said hall call instruction being generated by a user or passenger of the elevators;

(b) with respect to said first elevator controller, obtaining first condition data representing said given conditions for said specific rule;

(c) with respect to said first elevator controller, obtaining first instruction data from said first condition data in reference to said condition-instruction table, said first instruction data representing said given instructions for said specific rule;

(d) obtaining a first instruction value from contents of said first instruction data;

(e) provisionally assigning a hall call instruction to said second elevator controller;

(f) with respect to said second elevator controller, obtaining second condition data representing said given conditions for said specific rule;

(g) with respect to said second elevator controller, obtaining second instruction data from said second condition data in reference to said condition-instruction table, said second instruction data representing said given instructions for said specific rule;

(h) obtaining a second instruction value from contents of said second instruction data; and (i) comparing said first instruction value with said second instruction value, assigning said hall call instruction to said first elevator controller when said first instruction value exceeds said second instruction value so that an elevator cage of said first elevator controller goes to a floor from which said hall call instruction is generated, and assigning said hall call instruction to said second elevator controller when said second instruction value exceeds said first instruction value so that an elevator cage of said second elevator controller goes to a floor from which said hall call instruction is generated.

7. An apparatus according to claim 5, wherein said elevator control means further has functions of:

(f) provisionally assigning a hall call instruction to said first elevator controller, said hall call instruction being generated by a user or passenger of the elevators;

(g) with respect to said first elevator controller, obtaining first condition data representing said given conditions for said specific rule;

(h) with respect to said first elevator controller, obtaining first instruction data from said first condition data in reference to said condition-instruction table, said first instruction data representing said given instructions for said specific rule;

(i) obtaining a first instruction value from contents of said first instruction data;

(j) provisionally assigning a hall call instruction to said second elevator controller;

(k) with respect to said second elevator controller, obtaining second condition data representing said given conditions for said specific rule;

(l) with respect to said second elevator controller, obtaining second instruction data from said second condition data in reference to said condition-instruction table, said second instruction data representing said given instructions for said specific rule;

(m) obtaining a second instruction value from contents of said second instruction data; and (n) comparing said first instruction value with said second instruction value, assigning said hall call instruction to said first elevator controller when said first instruction value exceeds said second instruction value so that an elevator cage of said first elevator controller goes to a floor from which said hall call instruction is generated, and assigning said hall call instruction to said second elevator controller when said second instruction value exceeds said first instruction value so that an elevator cage of said second elevator controller goes to a floor from which said hall call instruction is generated.

* * * * *